US009802211B2

(12) United States Patent
Joseph et al.

(10) Patent No.: US 9,802,211 B2
(45) Date of Patent: Oct. 31, 2017

(54) SPRAY HEAD ASSEMBLIES FOR LIQUID SPRAY GUNS

(71) Applicant: 3M INNOVATIVE PROPERTIES COMPANY, St. Paul, MN (US)

(72) Inventors: Stephen C. P. Joseph, Woodbury, MN (US); Brian E. Duncan, St. Paul, MN (US)

(73) Assignee: 3M INNOVATIVE PROPERTIES COMPANY, Saint Paul, MN (US)

( * ) Notice: Subject to any disclaimer, the term of this patent is extended or adjusted under 35 U.S.C. 154(b) by 358 days.

(21) Appl. No.: 13/648,310

(22) Filed: Oct. 10, 2012

(65) Prior Publication Data

US 2013/0092760 A1 Apr. 18, 2013

Related U.S. Application Data

(60) Provisional application No. 61/546,249, filed on Oct. 12, 2011.

(51) Int. Cl.

| | |
|---|---|
| ***B05B 7/06*** | (2006.01) |
| ***B05B 7/08*** | (2006.01) |
| ***B05B 7/24*** | (2006.01) |
| ***B05B 15/06*** | (2006.01) |
| ***B05B 7/02*** | (2006.01) |

(52) U.S. Cl.

CPC ..... *B05B 7/0861* (2013.01); *B05B 7/02* (2013.01); *B05B 7/066* (2013.01); *B05B 7/0815* (2013.01); *B05B 7/2402* (2013.01); *B05B 7/2478* (2013.01); *B05B 15/06* (2013.01); *B05B 7/2405* (2013.01); *Y10T 29/49826* (2015.01)

(58) Field of Classification Search

CPC ..... B05B 7/066; B05B 7/0815; B05B 7/0861; B05B 7/2402; B05B 7/2478; B05B 15/06; B05B 15/066; B05B 15/067

See application file for complete search history.

(56) References Cited

U.S. PATENT DOCUMENTS

| | | | |
|---|---|---|---|
| 1,299,290 | A | 4/1919 | Berg |
| 1,539,536 | A | 5/1925 | Bartling |
| 1,748,440 | A | 2/1930 | Burdick |
| 2,042,746 | A | 6/1936 | Tracy |
| 2,059,706 | A | 11/1936 | Paasche |
| 2,126,888 | A | 8/1938 | Jenkins |
| 2,303,280 | A | 9/1940 | Jenkins |

(Continued)

FOREIGN PATENT DOCUMENTS

| | | |
|---|---|---|
| CN | 1280885 | 1/2001 |
| CN | 2431971 | 5/2001 |

(Continued)

OTHER PUBLICATIONS

PCT International Search Report for PCT/US2012/059445, dated Mar. 28, 2013.

(Continued)

*Primary Examiner* — Ryan Reis

(74) *Attorney, Agent, or Firm* — Aleksander Medved

(57) ABSTRACT

Spray head assemblies, including an air-handling saddle that is attachable to a liquid spray gun platform, a liquid-handling core that is slidably engagable into the air-handling saddle, and an air cap; spray guns using such assemblies; and, methods of using such assemblies.

28 Claims, 12 Drawing Sheets

(56) References Cited

U.S. PATENT DOCUMENTS 2,362,946 A 11/1944 Stockdale
2,497,625 A 2/1950 Norwick
2,820,670 A 1/1958 Charlop
2,886,252 A 5/1959 Ehrensperger
2,904,262 A 9/1959 Peeps
2,991,940 A 7/1961 Dupler
3,062,453 A 11/1962 Matthews
3,157,360 A 11/1964 Heard
3,168,250 A 2/1965 Paasche
3,236,459 A 2/1966 McRitchie
3,270,920 A 9/1966 Nessler
3,515,354 A 6/1970 Presson
3,581,998 A 6/1971 Roche
3,623,669 A 11/1971 Woods
3,633,828 A 1/1972 Larson
3,876,150 A 4/1975 Dwyer
3,942,680 A 3/1976 Seeley
4,160,525 A 7/1979 Wagner
4,392,617 A 7/1983 Bakos
4,403,738 A 9/1983 Kern
4,513,913 A 4/1985 Smith
4,529,126 A 7/1985 Ives
4,537,357 A 8/1985 Culbertson
4,562,965 A * 1/1986 Ihmels et al. ..... 239/346
4,615,485 A 10/1986 Larson
4,657,184 A 4/1987 Weinstein
4,660,774 A 4/1987 Kwok
4,712,739 A 12/1987 Bihn
4,760,962 A 8/1988 Wheeler
4,811,904 A 3/1989 Ihmels
4,815,666 A 3/1989 Gacka
4,817,872 A 4/1989 Mattson
4,830,281 A 5/1989 Calder
4,925,101 A 5/1990 Konieczynski
4,971,251 A 11/1990 Dobrick
4,993,642 A 2/1991 Hufgard
5,022,590 A 6/1991 Buschor
5,110,011 A 5/1992 Laska
5,119,992 A 6/1992 Grime
5,152,460 A 10/1992 Barty
5,178,330 A 1/1993 Rodgers
5,242,115 A 9/1993 Brown
5,279,461 A 1/1994 Darroch
5,280,853 A 1/1994 Perret
5,322,221 A 6/1994 Anderson
5,332,156 A 7/1994 Wheeler
5,395,046 A 3/1995 Knobbe
5,454,517 A 10/1995 Naemura
5,456,414 A 10/1995 Burns
5,474,450 A 12/1995 Chronister
5,582,350 A 12/1996 Kosmyna
5,607,108 A 3/1997 Garlick
5,609,302 A * 3/1997 Smith ..... 239/526
5,613,637 A 3/1997 Schmon
5,711,421 A 1/1998 Guo
5,765,753 A 6/1998 Kieffer
5,875,971 A 3/1999 Morck
5,961,050 A 10/1999 Kitajima
5,979,797 A 11/1999 Castellano
6,012,651 A 1/2000 Spitznagel
6,019,294 A 2/2000 Anderson
6,056,213 A * 5/2000 Ruta et al. ..... 239/337
6,068,203 A 5/2000 DeYoung
6,085,996 A 7/2000 Culbertson
D429,794 S 8/2000 Beaver
6,098,902 A 8/2000 Culbertson
6,105,881 A 8/2000 Kitajima
6,254,015 B1 7/2001 Abplanalp
6,345,776 B1 2/2002 Hurray
6,375,096 B1 4/2002 Rashidi
6,425,536 B2 7/2002 Namura
6,450,422 B1 9/2002 Maggio
6,460,787 B1 10/2002 Hartle
6,471,144 B1 10/2002 Huang
6,494,387 B1 12/2002 Kaneko
6,502,763 B1 1/2003 McCann
6,536,687 B1 3/2003 Navis
6,543,705 B1 4/2003 Liao
6,601,782 B1 8/2003 Sandholm
6,685,106 B1 2/2004 Van der Steur
6,702,198 B2 3/2004 Tam
6,719,212 B1 4/2004 Leisi
6,749,132 B2 6/2004 Pettit
6,793,155 B2 9/2004 Huang
6,805,306 B1 * 10/2004 Huang ..... 239/375
6,808,122 B2 10/2004 Mitcheli
6,820,824 B1 11/2004 Joseph
6,854,667 B2 2/2005 Ulrich
6,860,438 B1 3/2005 Huang
6,874,702 B2 4/2005 Turnbull
6,935,577 B2 8/2005 Strong
6,953,155 B2 10/2005 Joseph
6,971,590 B2 12/2005 Blette
7,032,839 B2 4/2006 Blette
7,083,119 B2 8/2006 Bouic
7,097,118 B1 8/2006 Huang
7,165,732 B2 1/2007 Kosmyna
D538,886 S 3/2007 Huang
7,201,336 B2 4/2007 Blette et al.
D542,375 S 5/2007 Blette
D542,376 S 5/2007 Blette
7,237,727 B2 7/2007 Wang
7,246,759 B2 7/2007 Turnbull
D548,816 S 8/2007 Schmon
7,328,855 B2 2/2008 Chatron
RE40,433 E 7/2008 Schmon
D572,343 S 7/2008 Huang
7,484,676 B2 2/2009 Joseph
7,513,443 B2 4/2009 Escoto, Jr.
7,694,896 B2 4/2010 Turnbull
D616,527 S 5/2010 Anderson
7,712,682 B2 5/2010 Joseph
7,757,972 B2 7/2010 Kosmyna
7,789,324 B2 9/2010 Bouic
7,789,327 B2 9/2010 Micheli
7,798,061 B2 9/2010 Dilou
7,891,588 B2 2/2011 Jones
7,922,107 B2 * 4/2011 Fox ..... 239/600
7,971,806 B2 7/2011 Johnson
8,066,205 B2 11/2011 Bass
8,297,536 B2 10/2012 Ruda
8,313,047 B2 11/2012 Micheli
8,360,345 B2 1/2013 Micheli
8,500,043 B2 8/2013 Heigl
8,590,809 B2 11/2013 Escoto, Jr.
8,684,281 B2 4/2014 Micheli
2002/0104898 A1 8/2002 Bonningue
2003/0071144 A1 4/2003 Naemura
2003/0111553 A1 6/2003 Hunter
2003/0173419 A1 9/2003 Huang
2004/0089742 A1 5/2004 Antonucci
2004/0140373 A1 7/2004 Joseph
2004/0195401 A1 10/2004 Strong
2004/0245673 A1 12/2004 Allsop
2004/0256484 A1 12/2004 Joseph et al.
2004/0256493 A1 12/2004 Turnbull
2005/0016448 A1 1/2005 Dilou
2005/0035220 A1 2/2005 Brown
2005/0045741 A1 3/2005 Brown
2005/0087128 A1 4/2005 Jakupovic
2005/0145724 A1 7/2005 Blette
2005/0173561 A1 8/2005 Cotter
2006/0000927 A1 1/2006 Ruda
2006/0065761 A1 3/2006 Joseph
2006/0097070 A1 5/2006 Huffman
2006/0102550 A1 5/2006 Joseph
2006/0175433 A1 8/2006 Escoto, Jr.
2006/0186223 A1 8/2006 Wang
2007/0102535 A1 5/2007 Carey
2007/0262169 A1 11/2007 Wang
2007/0262172 A1 11/2007 Huffman
2008/0078849 A1 4/2008 Fox
2008/0093479 A1 4/2008 Delbridge
2008/0272213 A1 * 11/2008 Ting ..... 239/461

(56) References Cited

U.S. PATENT DOCUMENTS

| | | | |
|---|---|---|---|
| 2009/0026290 | A1 | 1/2009 | Fox |
| 2009/0121048 | A1 | 5/2009 | Noshima |
| 2009/0302133 | A1 | 12/2009 | Micheli |
| 2010/0108783 | A1 | 5/2010 | Joseph |
| 2010/0123024 | A1 | 5/2010 | Gohring |
| 2010/0133358 | A1 | 6/2010 | Goehring |
| 2010/0187333 | A1 | 7/2010 | Escoto, Jr. |
| 2010/0282868 | A1 | 11/2010 | Heigl |
| 2011/0168811 | A1 | 7/2011 | Fox |
| 2013/0092760 | A1 | 4/2013 | Joseph |
| 2013/0327850 | A1 | 12/2013 | Joseph |
| 2014/0014741 | A1 | 1/2014 | Escoto |
| 2014/0246519 | A1 | 9/2014 | Johnson |
| 2015/0028131 | A1 | 1/2015 | Joseph |

FOREIGN PATENT DOCUMENTS

| | | |
|---|---|---|
| CN | 1827231 | 9/2006 |
| DE | 3815327 | 11/1989 |
| DE | 4027421 | 3/1992 |
| DE | 4 302 911 | 8/1993 |
| DE | 19503495 | 8/1996 |
| DE | 19605227 | 8/1997 |
| DE | 10315426 | 6/2004 |
| DE | 60005536 | 7/2004 |
| DE | 10 2004 027789 | 2/2005 |
| DE | 102004044475 | 12/2005 |
| DE | 10 2007 012989 | 10/2007 |
| DE | 202011050102 | 9/2011 |
| EP | 279992 | 8/1988 |
| EP | 509367 | 10/1992 |
| EP | 0492333 | 3/1995 |
| EP | 0885658 | 12/1998 |
| EP | 1340550 | 9/2003 |
| EP | 1 479 447 | 11/2004 |
| EP | 1554051 | 4/2006 |
| EP | 1682231 | 7/2006 |
| EP | 1699565 | 6/2008 |
| EP | 1 964 616 | 9/2008 |
| EP | 1964616 | 9/2008 |
| EP | 2108460 | 10/2009 |
| EP | 2386360 | 11/2011 |
| EP | 2486985 | 8/2012 |
| GB | 425382 | 9/1934 |
| GB | 829370 | 3/1960 |
| GB | 1231041 | 5/1971 |
| GB | 1293341 | 10/1972 |
| GB | 1338099 | 11/1973 |
| JP | 63-39448 | 3/1988 |
| JP | H07-265751 | 10/1995 |
| JP | H1028906 | 2/1998 |
| JP | 11114458 | 4/1999 |
| JP | 20021169 | 1/2002 |
| JP | 2003112086 | 4/2003 |
| JP | 2005-211699 | 8/2005 |
| JP | 2007175650 | 7/2007 |
| KR | 10-0435685 | 6/2004 |
| KR | 20-0428831 | 10/2006 |
| NL | 1024774 | 6/2004 |
| RU | 2014906 | 6/1994 |
| RU | 2060383 | 5/1996 |
| SU | 172206 | 1/1965 |
| SU | 1111832 | 9/1984 |
| SU | 1423175 | 9/1988 |
| SU | 1613181 | 12/1990 |
| WO | 03/051524 | 6/2003 |
| WO | 2004/037432 | 5/2004 |
| WO | 2004/037433 | 5/2004 |
| WO | 2004/087332 | 10/2004 |
| WO | 2005/049145 | 6/2005 |
| WO | 2005/063361 | 7/2005 |
| WO | 2006/053229 | 5/2006 |
| WO | 2006/098623 | 9/2006 |
| WO | 2006/107935 | 10/2006 |
| WO | 2007/056589 | 5/2007 |
| WO | 2007/104967 | 9/2007 |
| WO | 2007/139639 | 12/2007 |
| WO | 2008/016557 | 2/2008 |
| WO | WO 2009/0113980 | 9/2009 |
| WO | 2012/109298 | 8/2012 |
| WO | 2013/016474 | 1/2013 |
| WO | 2013/055730 | 4/2013 |
| WO | WO 2015/009475 | 1/2015 |

OTHER PUBLICATIONS

Ihmels, Manfred, Ihmels Article—SATA, Feb. 15, 1989, 2 pages.
Supplementary European Search Report for EP 12840409, dated Jun. 30, 2015.

* cited by examiner

SPRAY HEAD ASSEMBLIES FOR LIQUID SPRAY GUNS

BACKGROUND

Spray guns are used in many different facilities to spray liquids for a wide variety of purposes. For example, spray guns are widely used in vehicle body repair shops when spraying a vehicle with liquid coating media, e.g., primer, paint and/or clearcoat. Often, such spray guns are configured to emit liquid from one or more liquid-spray orifices; and, to emit so-called center air from one or more center air orifices, which center air may assist in atomizing the liquid into a spray of small droplets; and, to emit so-called fan air from one or more fan air orifices, which fan air may assist in shaping the spray of atomized liquid droplets into a desired pattern.

SUMMARY

Disclosed herein in various aspects are spray head assemblies, which may include an air-handling saddle that is attachable to a liquid spray gun platform, a liquid-handling core that is slidably engagable into the air-handling saddle, and an air cap; spray guns using such assemblies; and, methods of using such assemblies.

Disclosed herein in one aspect is a spray head assembly for use with a liquid spray gun platform, comprising: an air-handling saddle that is attachable to the liquid spray gun platform, an air cap that is attachable to the air-handling saddle, and a liquid-handling core that is slidably engagable into the air-handling saddle and that is securable in its engaged position therewithin by the attaching of the air cap to the air-handling saddle.

Disclosed herein in another aspect is a method of changing a liquid-handling core of a spray head assembly, comprising: detaching an air cap from an air-handling saddle of the spray head assembly; slidably disengaging a first liquid-handling core from the air-handling saddle and removing the core from contact with the saddle, slidably engaging a second liquid-handling core into the air-handling saddle; and, attaching an air cap to the air-handling saddle in such manner that the second liquid-handling core is secured in place in the air-handling saddle by the attaching of the air cap to the air-handling saddle.

Disclosed herein an another aspect is a spray head assembly for use with a liquid spray gun platform, comprising: an air-handling saddle that is attachable to the liquid spray gun platform, an air cap that is attachable to the air-handling saddle, and a liquid-handling core that is slidably engagable into the air-handling saddle; wherein the air-handling saddle consists of a unitary piece of integrally molded plastic that comprises at least one center air passage and at least one fan air passage.

Disclosed herein in yet another aspect is a spray head assembly for use with a liquid spray gun platform, comprising: an air-handling saddle that is attachable to the liquid spray gun platform, an air cap that is attachable to the air-handling saddle, and a liquid-handling core that is slidably engagable into the air-handling saddle; wherein the liquid-handling core consists of a unitary piece of molded plastic that is removable from the saddle and that is disposable; and, wherein the liquid-handling core does not include a needle that is removable from the liquid spray gun platform along with the liquid-handling core; wherein the liquid-handling core does not include, or provide any part of, a center air passage or a fan air passage; and, wherein a liquid-handling passage of the liquid-handling core comprises a liquid-handling junction that fluidly connects a liquid-entry passage that is within a hollow protrusion that protrudes generally radially outward from a hollow shaft of the liquid-handling core, to an elongate chamber within the hollow shaft of the liquid-handling core, and wherein when the core is slidably engaged into the air-handling saddle and the air-handling saddle is attached to the liquid spray gun platform, no part of the liquid spray gun platform is located forward of the liquid-handling junction of the liquid-handling passage of the liquid-handling core.

Also disclosed herein is a spray gun comprising a liquid-handling core that is slidably engagable into a gun platform of the spray gun and an air cap that is attachable to the gun platform, wherein the liquid-handling core is securable in its engaged position within the gun platform by the attaching of the air cap to the gun platform.

These and other aspects of the invention will be apparent from the detailed description below. In no event, however, should the above summaries be construed as limitations on the claimable subject matter, whether such subject matter is presented in claims in the application as initially filed or in claims that are amended or otherwise presented in prosecution.

Figure 1:
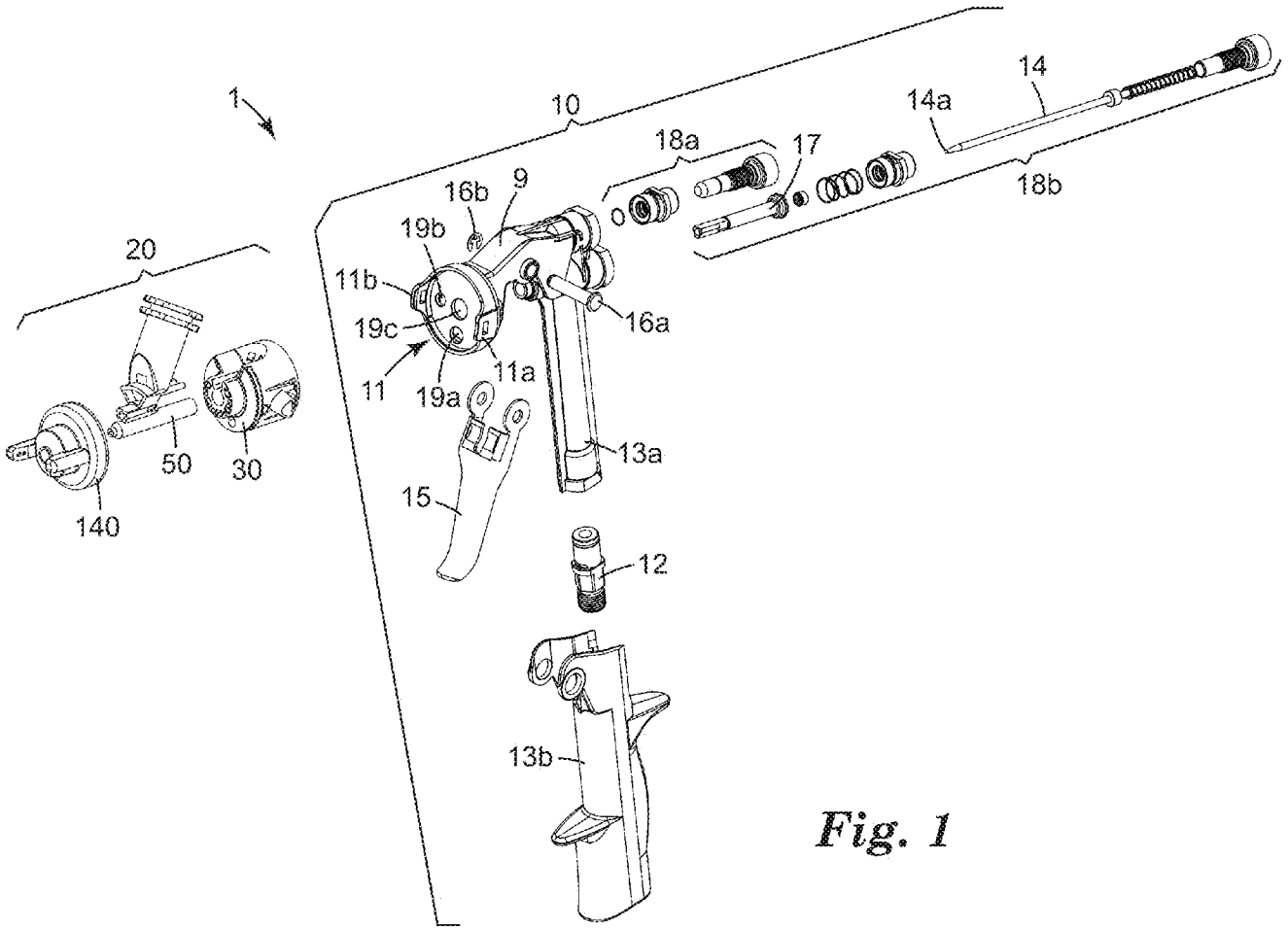
FIG. 1 is an exploded perspective view of one illustrative embodiment of a liquid spray gun as described herein.

Like reference numbers in the various figures indicate like elements. Some elements may be present in identical or equivalent multiples; in such cases only one or more representative elements may be designated by a reference number but it will be understood that such reference numbers apply to all such identical elements. Unless otherwise indicated, all figures and drawings in this document are not to scale and are chosen for the purpose of illustrating different embodiments of the invention. In particular the dimensions of the various components are depicted in illustrative terms only, and no relationship between the dimensions of the various components should be inferred from the drawings, unless so indicated.

Although terms such as "top", "bottom", "upper", "lower", "under", "over", "front", "back", "outward", "inward", "up" and "down", and "first" and "second" may be used in this disclosure, it should be understood that those terms are used in their relative sense only unless otherwise noted. Terms such as front, front-facing, forward, forwardmost, etc., refer to directions toward the end of a liquid spray head assembly and/or gun from which liquid spray is emitted (e.g., toward the left side of FIG. 1), and terms such as rear, rear-facing, rearward, rearwardmost, etc., refer to directions toward the opposing end of a liquid spray head assembly and/or gun (e.g., toward the right side of FIG. 1). Terms such as internal, inward, inward-facing, inwardmost, etc., refer to directions toward the interior of a liquid spray head assembly or a component thereof; terms such as external, outward, outward-facing, outwardmost, etc., refer to directions toward the exterior of a liquid spray head assembly or a component thereof. Terms such as radially (as in radially-outward, radially-inward, etc.) are with respect to a longitudinal axis of an elongated component and/or with respect to an axis generally aligned with the flow of a fluid along a path, noting that the terms do not require a strict ninety degree relationship with respect to such axes and does not require a strictly circular geometry (e.g., of a surface described e.g. as "radially-outwardly facing").

DETAILED DESCRIPTION

Disclosed herein are spray head assemblies that may be mated to liquid spray gun platforms to form liquid spray guns. One illustrative embodiment of an exemplary spray head assembly 20 and liquid spray gun 1 is depicted in exploded view in FIG. 1 and as assembled in FIG. 2. A spray head assembly may comprise a liquid-handling core, an air-handling saddle, and an air cap, illustrative examples of which are shown as respective components 50, 30 and 140 of FIGS. 3-6. Liquid-handling cores, air-handling saddles, and air caps, will now each be discussed in further detail.

A liquid-handling core is broadly defined herein as a component that is configured to be slidably engaged into an air-handling saddle, and that comprises a liquid-handling passage that fluidly connects a liquid-handling passage inlet and a liquid-handling passage outlet (through which a liquid to be sprayed may exit the core). For example as illustrated in the exemplary embodiment of FIG. 5, liquid-handling core 50 may comprise liquid-handling passage 53 that fluidly connects liquid-handling passage inlet 54 and liquid-handling passage outlet 55. As shown in exemplary illustration in FIGS. 3-6, liquid-handling passage 53 may conveniently comprise elongate hollow chamber 56 within hollow shaft 51 of liquid-handling core 50, and may further comprise liquid-entry passage 52 which receives liquid through liquid-handling passage inlet 54 and which delivers liquid into elongate hollow chamber 56 via liquid-handling junction 57 (as seen most easily in e.g. FIG. 5). Hollow chamber 56 may be configured to admit needle 14 of gun platform 10 (see, e.g. FIG. 1) that is capable of closing liquid-handling passage outlet 55 when advanced in the forward direction (to the left in the views depicted in FIGS. 1, 3 and 4) and opening liquid-handling passage outlet 55 when retracted in the rearward direction (to the right in FIGS. 1, 3, and 4).

Figure 4:
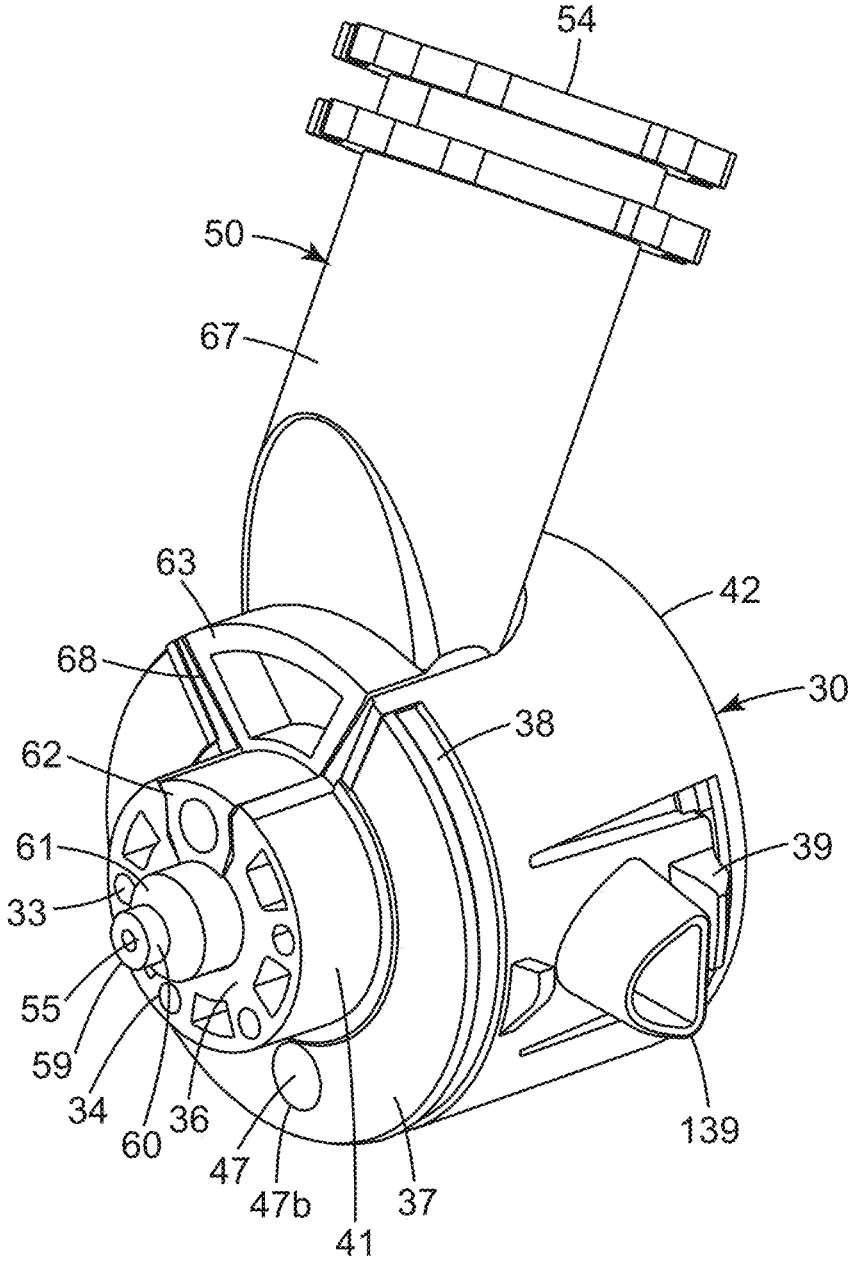
FIG. 4 is a perspective view of a portion of the spray head assembly of FIG. 3, as assembled.
Figure 5:
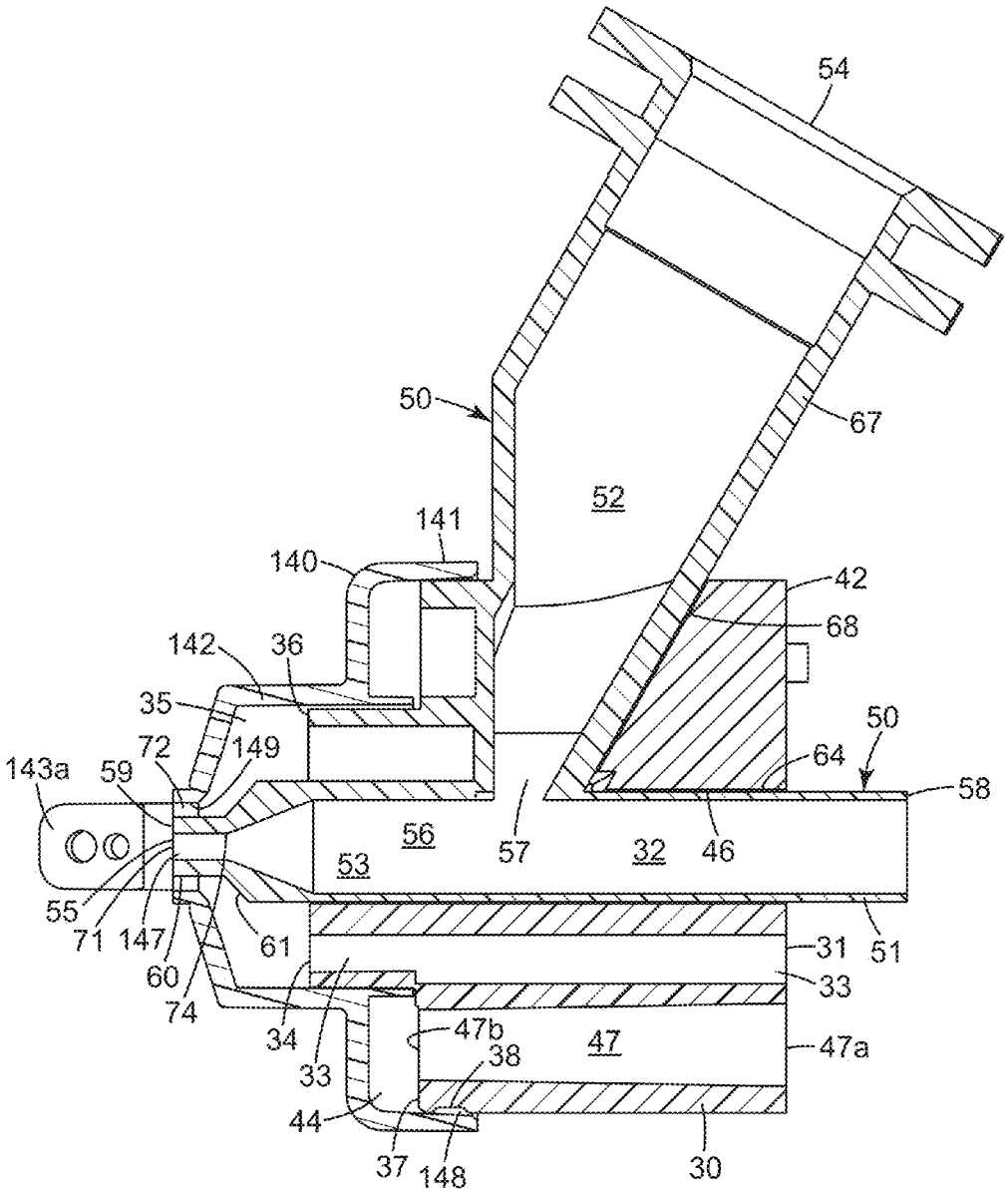
FIG. 5 is a cross-sectional view of the spray head assembly of FIG. 3, as assembled.

In ordinary use of a spray head assembly and spray gun as disclosed herein, a liquid-handling core is slidably engaged into an air-handling saddle. (It will be understood that terms such as slidably engaged "into" an air-handling saddle; in place "within" an air-handling saddle, etc., do not imply that a liquid-handling core when slidably engaged must be completely surrounded by, or enveloped within, an air-handling saddle). With specific reference to the exemplary embodiment of FIGS. 3 and 4, liquid-handling core 50 may comprise hollow shaft 51 that is slidably engagable into elongate cavity 32 of saddle 30. Hollow shaft 51 may comprise forward tip 59 that may comprise liquid-handling passage outlet 55, and may comprise rearward shank 58 that, when liquid-handling core 50 is slidably engaged into air-handling saddle 30 as shown in FIGS. 4 and 5, extends rearward into elongate cavity 32 of saddle 30. In various embodiments shank 58 may extend rearward to or past rear face 42 of air-handling saddle 30, and may extend rearward into shank-receiving opening 19*c* of gun platform 10. When gun 1 is assembled, e.g. a rearward portion of needle 14 of gun platform 10 may be within shank 58 of hollow shaft 51.

Hollow shaft 51 and elongate hollow chamber 56 therein may comprise a longitudinal axis that may be generally parallel to the direction of flow of liquid through hollow chamber 56 of liquid-handling passage 53 (after such liquid has entered hollow chamber 56 through liquid-handling junction 57) and through liquid-handling passage outlet 55. (This direction of liquid flow may be generally parallel to axis 100 of liquid flow out of liquid spray orifice 71 of spray head assembly 20 as seen e.g. in FIG. 6). In some embodiments, liquid-handling core 50 may comprise features or components at a desired location (e.g., within the interior of shank 58, that minimize the chance of liquid backflow. In alternative embodiments, no such features or components may be present. In at least some embodiments, the direction in which liquid-handling core 50 is slidably engagable into air-handling saddle 30 is rearward, along an axis that is generally aligned with the longitudinal axis of hollow shaft 51 and elongate chamber 56. Such designs should be contrasted with e.g. designs in which a component is inserted into a gun platform in a direction that is frontward toward the liquid-emitting end of the gun and/or along an axis that is not aligned with an elongate axis of the component and/or with an axis of liquid flow therethrough.

Liquid-handling core 50 may include an angled protruding portion 67 that is hollow so as to comprise liquid-entry passage 52, as seen e.g. in FIGS. 4 and 5. By angled is meant that a longitudinal axis of protruding portion 67 is not coincident with the longitudinal axis of hollow shaft 51. Although, in the illustrated embodiment, protruding portion 67 is shown extending upward and rearward from hollow shaft 51 at an angle of approximately 60 degrees, any suitable angle and orientation may be chosen. For example, portion 67 may protrude at an angle of approximately 90 degrees (i.e., generally straight out at a right angle from the longitudinal axis of shaft 51); or, it may protrude in a forward rather than a rearward direction. Moreover, portion 67 may protrude downward, or to the side, rather than upward. The ordinary artisan will recognize that various of these arrangements may be more convenient e.g. for gravity-feed spray guns, for siphon-feed spray guns, for positive-air-pressure-feed spray guns, and so on, all of which are within the scope of the disclosures herein.

In some embodiments, protruding portion 67 and liquid-handling passage inlet 54 thereof may be configured to mate with a separate container that contains the liquid to be sprayed. In such embodiments, protruding portion 67 may comprise any suitable connection with such a container; e.g., in specific embodiments, protruding portion 67 may comprise a closure member (e.g. a plug, seal, lid, etc.) that forms the closure of a container that is connectable to protruding portion 67 and that can contain the liquid to be sprayed. In other embodiments, protruding portion 67 may comprise an integral container portion, e.g. an integrally molded container portion with an opening into which the liquid may be poured.

Figure 3:
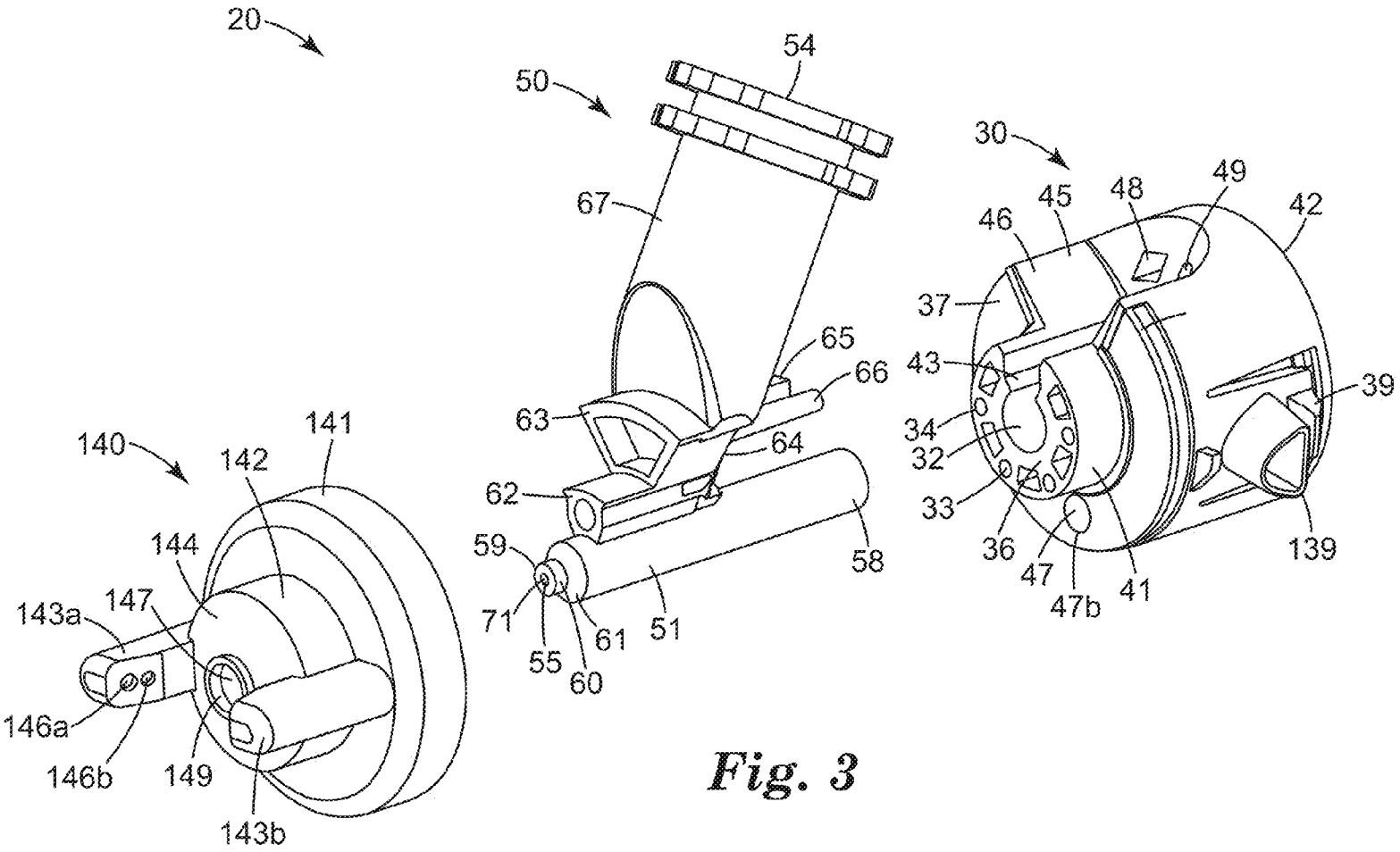
FIG. 3 is an exploded perspective view of one illustrative embodiment of a spray head assembly.

In some embodiments, a liquid-handling core may comprise at least one registration feature that is configured to mate with at least one registration feature of an air-handling saddle, e.g. as exemplified by respective features 65 and 48 of FIG. 3. In further exemplary embodiments, liquid-handling core 50 may comprise at least one additional registration feature 66 that is configured to mate with at least one additional registration feature 49 of saddle 30. Registration features 65 and 48 may be designed so that they slidably engage with each other as liquid-handling core 50 is slidably engaged into air-handling saddle 30. Features 65 and 48 may be further designed so that when engaged with each other, they do not prevent liquid-handling core 50 from being slidably disengaged from (and thus being removed from) air-handling saddle 30. Thus, in such embodiments registration features 65 and 48 do not serve as locking features that secure core 50 and saddle 30 together (that is, while they may provide e.g. resistance to rotation of core 50 relative to saddle 30, they do not prevent slidable disengagement of core 50 from saddle 30). In further embodiments, the axis along which features 65 and 48 are slidably engagable with each other is parallel to the axis along which core 50 is slidably engagable into saddle 30. Registration features 66 and 49 may likewise be designed to comprise any or all of these features.

Whether present as a single registration feature of core 50 and a corresponding single registration feature of saddle 30, or as two or more features on core 50 and saddle 30, such registration features may be asymmetrically designed, so that there is only one possible geometric arrangement of core 50 and saddle 30 that permits core 50 to be slidably engaged into saddle 30. For example, in the illustrated embodiment, registration features 65 and 66 of core 50 are square and round in cross section, respectively (with registration features 48 and 49 of saddle 30 being configured to match). Such an asymmetric arrangement may also be achieved with a single, asymmetric registration feature on core 50 and a corresponding registration feature on saddle 30.

Although the illustrated embodiment depicts male registration features on core 50 and female registration features on saddle 30, with the male registration features of core 50 extending rearward from protruding portion 67 of core 50, it will be understood that at least one registration feature of core 50 may be e.g. female and/or may be arranged at any suitable location on core 50, e.g. in combination with corresponding male registration features of saddle 30. Whichever of core 50 and/or saddle 30 is chosen to comprise a male registration feature, such a feature may conveniently comprise an elongated member (e.g. as shown in FIG. 3) which may provide e.g. enhanced stability against rotation of core 50 relative to saddle 30. Such stability may be particularly advantageous in at least some embodiments described herein (e.g., those in which core 50 is engaged onto the front of gun platform 10 rather than being sandwiched or otherwise enveloped within the body of a gun platform).

In at least some embodiments, a liquid-handling core may not comprise any air-handling passages, for center air and/or for fan air. In some embodiments of this type, a liquid-handling core may not contain any center air or fan air passages leading through any portion of the interior of the liquid-handling core. In further embodiments of this type, when a liquid-handling core is slidably engaged into an air-handling saddle, no portion of any interior or exterior surface of the liquid-handling core will provide (e.g., form, define, etc.) any portion of a center air or fan air handling passage. It will be appreciated that in such embodiments, a liquid-handling core may play no part in the delivering of center air to a center air chamber and no part in the delivering of fan air to a fan air chamber. In alternative embodiments, a liquid-handling core may comprise at least one center air handling passage but not a fan air handling passage; or, at least one fan air handling passage but not a center air handling passage; or, at least one center air handling passage and at least one fan air handling passage.

In some embodiments, a liquid-handling core may not comprise any aperture-containing member (e.g., flange) or members that protrude outwardly from a hollow shaft (e.g., shaft 51) thereof and that e.g., when a spray gun is assembled, are located at an interface between fluidly-connected air passages and/or conduits so as to minimize air leakage at the interface.

In at least some embodiments, a liquid-handling core is removable from an air-handling saddle and thus from a spray head assembly (after which it may be disposed, or may be cleaned and reused, as the user desires). In particular embodiments, the liquid-handling core is disposable. As used here and elsewhere herein, the term "disposable" denotes a component that, in ordinary operation of a spray gun, (e.g., during changeover from one paint to another), is customarily removed and disposed after a selected period of use, e.g. even if the component is still in good working order. This should be distinguished from spray gun components that (even though it might be possible to remove them e.g. if they become damaged) are customarily retained and reused repeatedly in ordinary operation of a spray gun.

In some embodiments a liquid-handling core may provide substantially all of the liquid-handling passages of a spray head assembly through which liquid is delivered to at least one liquid spray orifice of the spray head assembly of the spray gun. In such embodiments, the liquid-handling core may thus comprise substantially all of the interior surfaces of the spray head assembly with which (non-atomized) liquid comes into contact in the process of handling and spraying the liquid. In the context of exemplary spray head assembly 20 and liquid-handling core 50, by this is meant that except for surfaces of liquid-handling passage 53 of core 50, substantially no interior surface of any component of spray head assembly 20 is contacted by non-atomized liquid (with certain specific exceptions as may occur in specific embodiments noted later herein). It is also noted that the surface of at least a forwardmost portion of needle 14 may be contacted by non-atomized liquid in ordinary use of spray gun 1; however, as discussed later in the detailed description of gun platform 10, in such a context needle 14 may not be considered to be a component of spray head assembly 20 and in particular not a component of liquid-handling core 50. It is further noted that some surfaces of air cap 140 (e.g., surfaces of flange 144 and/or air horns 143*a*/143*b*) may be contacted by atomized liquid after the liquid exits liquid-handling passage outlet 55 of liquid-handling core 50. These distinctions notwithstanding, it will be appreciated that in at least the particular embodiments discussed in this paragraph, non-atomized liquid may not contact a surface of air-handling saddle 30; or, at most, minor amounts of liquid may be deposited on an insubstantial portion of a surface of saddle 30 (e.g. on a front face thereof) e.g. in such manner as to be easily removable therefrom.

Thus, in ordinary use of a spray head assembly as disclosed herein, disposing of a liquid-handling core (and optionally an air cap) of a spray head assembly may not necessarily mean that the air-handling saddle of the spray head assembly need also be disposed. The ordinary artisan will thus appreciate that designs in which a liquid-handling core, and optionally an air cap, may be the only components of a spray head assembly to be removed and disposed after use, may provide significant advantages. For example, such designs might negate the need to dispose and replace an air-handling component of a spray head, such a component often being a complex and expensive item.

In some embodiments, a liquid-handling core may be color-coded or otherwise bear some type of identifying indicia, e.g. to signify that a particular liquid-handling core 50 has a certain property (e.g. a liquid-handling passage outlet 55 of a particular diameter). In some embodiments, multiple liquid-handling cores may be provided that are identifiable as having different properties. For example, a kit may be provided comprising two or more liquid-handling cores 50 that differ e.g. in the diameter of their respective liquid-handling passage outlets 55), and that are color-coded and/or are otherwise marked accordingly.

A liquid-handling core may be made of any suitable material, including e.g. metals, metal alloys, plastics (e.g., moldable thermoplastic polymer resins, optionally containing any suitable additives, reinforcing fillers, etc., for any desired purpose), and the like, and any combinations thereof. In some embodiments, a liquid-handling core may be (e.g., consist of) a single unitary piece of integrally molded plastic. In alternative embodiments, a liquid-handling core may comprise two or more pieces e.g. that are attached to each other (e.g., adhered to each other by adhesive, snap-fitted together, welded together, etc.) to form the core.

Various other features and functions of liquid-handling cores, with specific reference to their interaction with various features and functions of air-handling saddles and air caps, will be discussed in further detail later herein.

An air-handling saddle is broadly defined herein as a component of a spray head assembly that is configured to slidably receive a liquid-handling core, and that comprises at least one center air passage that acts at least in part to deliver center air through a center air passage outlet (e.g., into a center air chamber as disclosed later herein), and/or at least one fan air passage that acts at least in part to delivery fan air through a fan air passage outlet (e.g., into a fan air chamber as disclosed later herein). The term air passage broadly encompasses e.g. an interior passage extending through at least a portion of the interior of the saddle, as well as an exterior "passage" defined at least in part by an exterior surface of the saddle (e.g., in combination with an overlying shroud, portion of a gun platform, etc.). In certain embodiments, the at least one center air passage is an interior passage. In alternative embodiments, the at least one center air passage is an exterior passage. In certain embodiments, the at least one fan air passage is an interior passage. In alternative embodiments, the at least one fan air passage is an exterior passage.

For example as depicted in the illustrative embodiment of FIGS. 3-6, exemplary air-handling saddle 30 may comprise at least one center air passage 33 that acts at least in part to deliver center air to center air orifice 72 of spray head assembly 20; and, at least one fan air passage 47 that acts at least in part to deliver fan air to fan air chamber 44 of spray head assembly 20. As shown in exemplary illustration in FIGS. 3-6, the at least one center air passage 33 may fluidly connect a center air passage inlet 31 located at the rear face 42 of saddle 30, to a center air passage outlet 34 located on a center air delivery face 36 of saddle 30. (It is noted that in the cross-sectional views of FIGS. 5 and 6, portions of saddle 30 are shown in additional cutaway (rather than in a strictly vertical cross-sectional view) so that center air passage 33 may be most easily seen. In addition, in FIGS. 5 and 6 some background surface lines have been omitted for clarity of presentation.) In the specific illustrative embodiment of FIGS. 3-6, multiple separate center air passages 33, each fluidly connected to a separate center air passage outlet 34, are provided, with the multiple center air passage outlets 34 arranged in a semicircle about a radially centrally located elongate cavity 32 (into which hollow shaft 51 of core 50 may be slidably engaged). Also, in the illustrated embodiment center air passages 33 are stepped (from a larger-area inlet 31 to a smaller-area outlet 34). However, any suitable configuration or arrangement of cavity 32 and center air passages 33 and outlets 34 may be used.

As shown in exemplary illustration in FIGS. 3-6, at least one fan air passage 47 may fluidly connect a fan air passage inlet **47*a* located at the rear face 42 of saddle 30, to a fan air passage outlet 47*b* located on a fan air delivery face 37 of saddle 30. Although in the exemplary design fan air passage outlet 47*b* is positioned below the center air passage outlets 34, and near a lowermost portion of saddle 30 (e.g., at an approximately six o'clock position on annular face 37 of saddle 30, as shown in FIGS. 3 and 4), outlet 47*b*** can be located at any suitable position.

In some embodiments, center air delivery face 36 of saddle 30 may comprise an interrupted annulus that is interrupted by primary slot 43; and, fan air delivery face 37 of saddle 30 may likewise comprise an interrupted annulus that is interrupted by secondary slot 45 (all as seen most easily in FIG. 3). In some embodiments, liquid-handling core 50 may comprise at least a primary key portion 62 that, when core 50 is slidably engaged into saddle 30, at least partially fills primary slot 43 and that may comprise a front-facing surface that is generally flush with at least a front-facing portion of center air delivery face 36 of saddle 30. Similarly, liquid-handling core 50 may comprise at least a secondary key portion 63 that, when core 50 is slidably engaged into saddle 30, at least partially fills secondary slot 45 in fan air delivery face 37 and that may comprise a front-facing surface that is generally flush with at least a front-facing portion of fan air delivery face 37 of saddle 30. Such arrangements (most easily seen in FIG. 4) may provide that when core 50 and saddle 30 are slidably engaged with each other, annular, front-facing surfaces (e.g., 36 and 37) may be provided that may e.g. at least partially define a center air chamber and a fan air chamber, as discussed in detail later herein.

In the illustrated embodiment of FIG. 4, center air delivery face 36 is positioned forward of fan air delivery face 37. In such cases at least forwardmost portions of center air passages 33 may be at least partially bounded by radially-outward-facing surface 41 of saddle 30. Surface 41 may e.g. be in the form of an interrupted annulus with a notch at least a forwardmost portion of which (when core 50 is engaged into saddle 30) may be filled by a radially-outward-facing surface of primary key portion 62 of core 50, as most easily seen in FIG. 4. (It should be noted that in the discussions herein, terms such as annular, annulus, and the like, are used for convenience of description, and do not require that any of the described components must necessarily be provided in a strictly circular geometry.)

When a liquid-handling core and an air-handling saddle are slidably engaged with each other, various surface areas of the core may closely abut, and/or be in contact with, various surface areas of the saddle. (Various exemplary contact areas 68, between surfaces 64 of core 50 and surfaces 46 of saddle 30, are illustrated in FIGS. 4 and 5.) In some embodiments, such close abutment/contact will be between hard surfaces, meaning that the contacting surfaces of both the core and the saddle are made of generally hard and rigid materials (e.g., with a Shore D hardness of at least 50) rather than generally soft and elastomeric materials. In such embodiments, such closely abutting and/or contacting surfaces of the core and the saddle may not necessarily, and in some cases do not, form an air-tight seal therebetween. In some embodiments, neither the core nor the saddle contain any threaded connections to aid or augment the slidable engagement therebetween.

As mentioned earlier, in some embodiments a saddle may have at least one registration feature that is configured to slidably engage with a corresponding registration feature of a core. Again as mentioned, different saddles and/or cores may be provided that are configured e.g. for top-feeding of liquid, bottom-feeding, side-feeding, etc. In such cases, saddles of each particular configuration may be provided with registration features that are only compatible with (i.e., only physically able to engage with) registration features of cores that are of a matching configuration, and vice versa.

It will be noted that in the exemplary design of saddle 30 presented herein, center air and fan air are handled by separate air-handling passages, that receive air from separate air supply conduits of gun platform 10. Such designs may be convenient but it may also be possible to obtain center air and fan air from a common source and/or to handle them collectively at least in part in mixed-air passages. It will also be noted that various hollow portions, cutouts and the like, are present in the exemplary core 50 and saddle 30 as depicted in the Figures. Those of ordinary skill will appreciate that such features may serve e.g. to minimize the weight and/or raw material cost of such components, while maintaining the mechanical strength and integrity thereof. The presence of such features should not obscure or detract from the various elements (liquid-handling passages, air-handling passages, etc.) discussed herein.

An air-handling saddle may be made of any suitable material, including e.g. metals, metal alloys, plastics (e.g., moldable thermoplastic polymer resins, optionally containing any suitable additives, reinforcing fillers, etc., for any desired purpose), and the like, and any combinations thereof. In some embodiments, an air-handling saddle may be (e.g., consist of) a single unitary piece of integrally molded plastic. In alternative embodiments, an air-handling saddle may comprise two or more pieces e.g. that are attached to each other (e.g., adhered to each other by adhesive, snap-fitted together, welded together, etc.) to form the saddle. Such an arrangement might take the form of e.g. a first saddle portion (e.g., a hollow shaft portion arranged to slidably receive a portion of a liquid-handling core) and a second saddle portion (e.g., a sheath portion arranged to at least partially contain or otherwise define, one or more air passages).

From the above description of air-handling saddles and liquid-handling cores it will be appreciated that in at least some of the embodiments presented herein, an advantageous spray head assembly may be provided in which substantially all of the liquid-handling is performed by a core (e.g., a disposable core) and substantially all of the air-handling is performed by the saddle. As mentioned, in at least some embodiments this may minimize time, effort, and/or expense in replacing liquid-contacted components of a spray gun, and in particular may enable rapid changeover from e.g. one color paint to another.

An air cap is broadly defined herein as a component of a spray head assembly that is configured to direct at least fan air onto a spray of liquid that is emitted from a liquid spray orifice of the spray head assembly and that is atomized by center air emitted from a center air orifice of the spray head assembly. Such an air cap may be conveniently positioned e.g. so that at least portions of the air cap are located forward of the air-handling saddle so that some surfaces of the air cap, in combination with some surfaces of the air-handling saddle (and, potentially, some surfaces of the fluid-handling core), define a fan-air chamber, as discussed in detail later herein.

In various embodiments, an air cap may be attached to an air-handling saddle and/or to (some portion of) a gun platform. In some embodiments, the air cap may be attachable to a saddle but not to a gun platform. In some embodiments, an air cap may be attachable to a saddle solely by way of attachment features that are unitary with and integral to (e.g., are molded along with), the air cap (e.g. in combination with attachment features of the saddle that are unitary with and integral to the saddle), without the use of any additional or auxiliary attachment mechanism such as e.g. one or more locking rings, locking caps, nuts, bolts, clips, pins, mechanical fasteners, tapes, adhesives, glues and so on. In other embodiments, an additional or auxiliary attachment mechanism may be used.

In broader embodiments, any suitable method of attaching an air cap to a saddle may be used. Such methods may include the use of e.g. threaded connections on the air cap and/or the saddle and/or on any additional or auxiliary attachment mechanism used therewith. Suitable methods may also include e.g. a bayonet-type mount, a Luer lock connection, a snap fit assembly, a friction-fit connection, and so on. With reference to the particular exemplary configuration illustrated in FIGS. 5 and 6, in some embodiments exemplary air cap 140 may be attached to exemplary saddle 30 in a manner that e.g. allows for at least partial rotation of air cap 140 (as shown by comparison of FIGS. 5 and 6) e.g. about an axis generally aligned with the axis of liquid flow through liquid spray orifice 71 of spray head assembly 20 (e.g., axis 100 of FIG. 6). Such a design may allow the orientation of air cap 140 to be adjusted to shape or otherwise adjust the orientation of the pattern of the atomized liquid spray emitted from spray gun 1. One exemplary manner in which air cap 140 can be attached to saddle 30 in such manner as to allow at least partial rotation of air cap 140 is by the use of annular ridge 148 that projects radially inward from at least portions of lip 141 of air cap 140, in combination with radially-outward facing semi-annular groove 38 of saddle 30 (as seen most easily e.g. in FIG. 5). In such designs, a radially-outward-facing surface of secondary key portion 63 of core 50 may similarly comprise a radially-outward facing annular groove segment (not shown in the Figures) that is congruent with groove 38 of saddle 30 when core 50 is engaged with saddle 30, so as to enhance the ability to attach air cap 140 to saddle 30 when core 50 is engaged with saddle 30.

In some embodiments, methods of attachment of an air cap to a saddle may be used in which an at least partial rotation of an air cap relative to a saddle (e.g., about an axis generally aligned with the axis of liquid flow through liquid spray orifice 71 of spray head assembly 20) serves to attach the air cap to the saddle. For example, engaging features (e.g. of the type designated by reference numbers 37, 47, and 47*a* of U.S. Patent Application 61/512,678 filed Jul. 28, 2011) may be provided on air cap 140 and saddle 30, so that rotating of air cap 140 relative to saddle 30 serves to engage the features together and to attach air cap 140 to saddle 30. (Engaging features of this general type are also illustrated in the exemplary air cap 340 depicted in FIG. 10 of the present application.)

In some embodiments, the liquid-handling core is securable in its engaged position within the air-handling saddle by the attaching of the air cap to the air-handling saddle. In such embodiments, the attaching of the air cap to the saddle serves as the sole mechanism by which the liquid-handling core is secured in its slidably engaged position within the saddle. Thus in such embodiments, no other auxiliary fastening mechanism (e.g., one or more locking rings, locking caps, nuts, bolts, clips, pins, mechanical fasteners, tapes, adhesives, glues, etc.) is used or required, in order to directly or indirectly secure the core in place within the saddle. Nor, in such embodiments, does any part of a gun platform serve such a function. Thus in such embodiments the only action may be necessary in order to enable the core to be slidably disengaged from the saddle (e.g., manually by a user, e.g. by the use of finger pressure) is to detach the air cap from the saddle; moreover, no other action or actions can serve to allow the core to be slidably disengaged from the saddle in the absence of the air cap being detached from the saddle. In particular embodiments of this type, the air cap is attachable to the saddle by way of attachment features of the air cap that are unitary with (e.g., integrally molded with) the air cap, optionally in combination with attachment features of the saddle that are unitary with (e.g., integrally molded with) the saddle.

In some embodiments the securing of the core in place in its slidably engaged position within the saddle may occur by way of at least a portion of the air cap contacting at least a portion of the core so as to directly hold it in place in its slidably engaged position. Thus in embodiments of the general type shown in FIGS. 1-6, air cap 140 may comprise one or more contact members (not shown in any Figure) that protrude e.g. radially inwardly and/or rearwardly from air cap 140 so as to contact a surface of liquid-handling core 50 and to securely hold core 50 in place in its slidably engaged position within saddle 30. Such a contact member or members might be provided in the form of e.g. one or more ribs or flanges that protrude from air cap 140 so as to contact e.g. surface 61 of core 50 (such members may of course be arranged so as to not unduly interfere with the distribution of center air from center air chamber 35 into center air orifice 72).

In other embodiments described later herein, direct contact between an air cap and a core may not be necessary (e.g., in order to secure the core in its slidably engaged configuration). However, as long as the above-listed requirements are met, such designs still meet the condition that the attaching of the air cap to the saddle serves as the sole mechanism by which the liquid-handling core is secured in its slidably engaged position within the saddle.

In some embodiments, the air cap may combine with the saddle and/or the core to define a fan air chamber. For example, with reference to the exemplary illustrations of FIGS. 5 and 6, air cap 140 (e.g., various rearward-facing and/or radially-inwardly-facing surfaces thereof) may combine with saddle 30 and/or core 50 (e.g., various forward-facing and/or radially-outwardly-facing surfaces thereof) to define fan air chamber 44. In specific embodiments, such forward-facing surfaces of saddle 30 and core 50 may comprise an annular fan air delivery face collectively formed by interrupted annular face 37 of saddle 30, and secondary key portion 63 of liquid-handling core 50 that fills secondary slot 45 of interrupted annular face 37 of saddle 30, again as seen most easily in FIGS. 5 and 6.

A fan air chamber (e.g., 44) is defined as a chamber (i.e., plenum) that accepts air from at least one fan air passage of an air-handling saddle via at least one fan air passage outlet of the saddle, and that distributes the accepted fan air into at least two separate pathways such that the distributed fan air may shape an atomized liquid spray (as such, fan air chamber 44 is distinguished from a fan air passage (e.g., 47) of saddle 30). Such separate pathways along which the fan air of fan air chamber 44 may be distributed may be provided e.g. by air horns 143*a* and 143*b* (seen most easily in FIG. 6), each of which defines a horn cavity 145*a* and 145*b* (respectively) into which fan air is distributed from fan air chamber 44. Fan air delivered into air horn cavities 145*a* and 145*b* exits the cavities through apertures 146*a* and 146*b* on air horns 143*a* and 143*b*. Apertures 146*a* and 146*b* on horns 143*a* and 143*b* may be e.g. located on generally opposite sides of atomized-liquid-flow axis 100 such that air distributed by fan air chamber 44 flows against generally opposite sides of a stream of liquid emitted from orifice 71 and atomized as described herein. The forces exerted by the fan air can be used to change the shape of the stream of liquid to form a desired spray pattern (e.g., circular, elliptical, etc.). The size, shape, orientation, and other features of the apertures may be adjusted to achieve different fan control characteristics. In the depicted embodiment, the apertures 146*a* and 146*b* are in the form of circular bores.

Figure 6:
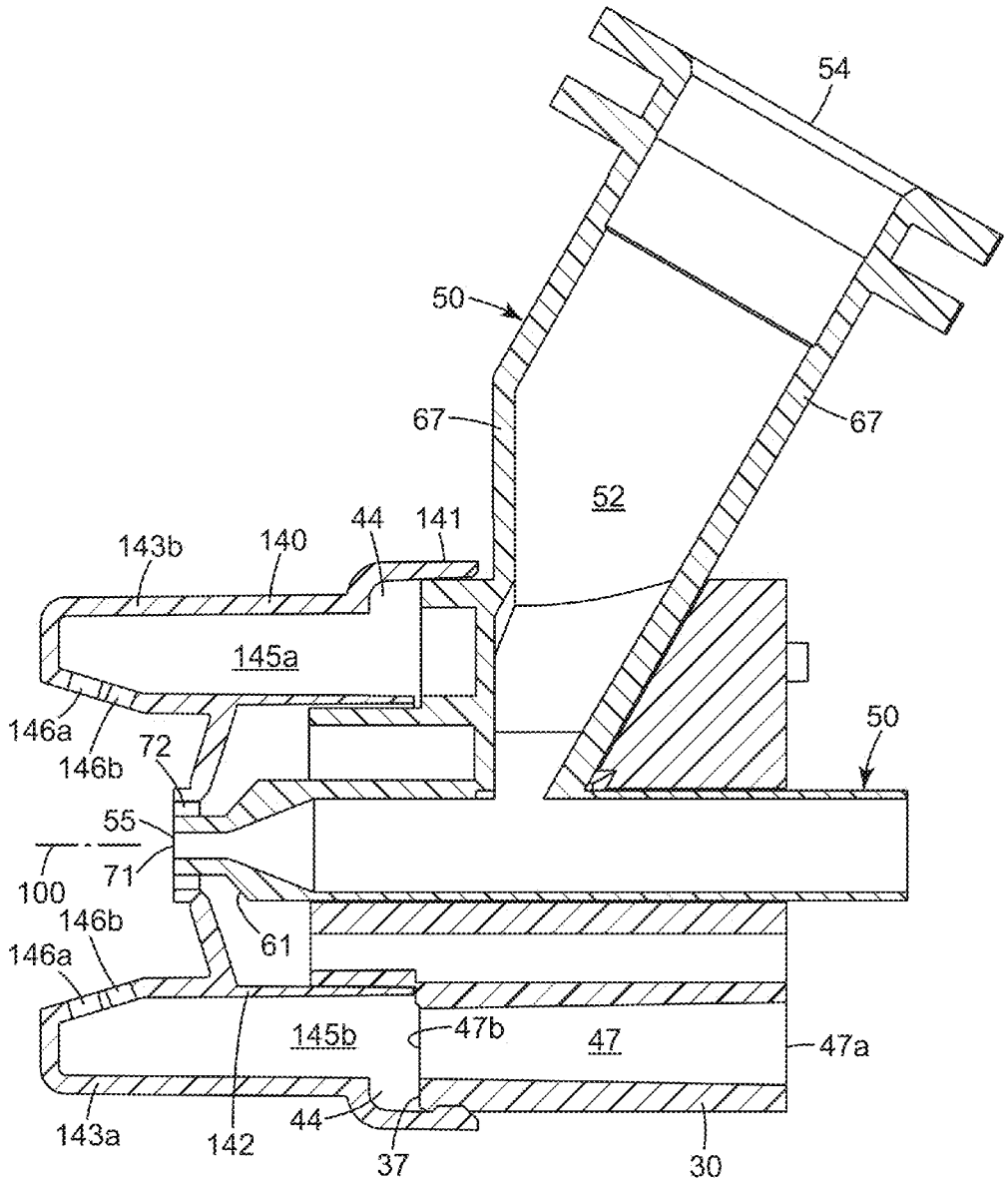
FIG. 6 is a cross-sectional view of the spray head assembly of FIG. 5, with air cap 140 rotated approximately ninety degrees relative to the view depicted in FIG. 5.

With reference to the exemplary illustrations of FIGS. 5 and 6, an air cap (e.g., rearward-facing surfaces of flange 144 of air cap 140, and/or radially-inwardly-facing surfaces of annular sidewall 142 thereof) may combine with various surfaces of a saddle and/or of a core (e.g., forward-facing and/or radially-outwardly-facing surfaces thereof) to at least partially define a center air chamber (e.g., 35). In specific embodiments, such forward-facing surfaces of saddle 30 and core 50 may comprise an annular center air delivery face collectively formed by interrupted annular face 36 of saddle 30, and primary key portion 62 of liquid-handling core 50 that fills primary slot 43 of interrupted annular face 36 of saddle 30, again as seen most easily in FIGS. 5 and 6.

A center air chamber (e.g., 35) is defined as a chamber (i.e., plenum) that accepts center air from at least one center air passage of an air-handling saddle via at least one center air passage outlet of the saddle, and that distributes the accepted center air into at least one center air orifice of the spray head assembly such that the center air emitted from the orifice can assist in atomizing the liquid emerging from a liquid spray orifice of the spray head assembly (as such, a center air chamber is distinguished from a center air passage of a saddle).

A center air orifice of the spray head assembly may be e.g. an annular orifice (e.g., 72) that substantially, or completely, surrounds the liquid spray orifice (e.g., 71) of the spray head assembly such that the center air passing through the center air orifice can most advantageously atomize and form the liquid emerging from the liquid spray orifice into e.g. a generally conical stream of fine droplets. In the illustrated embodiment of FIGS. 1-6, liquid spray orifice 71 is provided by liquid-handling passage outlet 55 of liquid-handling core 50; and, annular center air orifice 72 is collectively provided by radially outward-facing surface 60 of core 50 (that is proximal to tip 59 and outlet 55 of core 50), in combination with radially inward-facing surface 149 of opening 147 of flange 144 of air cap 140.

Other configurations are possible in which a center air orifice and/or a liquid spray orifice of a spray head assembly may be provided in a different manner than in the representative embodiments described above, and are discussed in detail later herein. In the context of any of the configurations described here and elsewhere herein, the above discussions make it clear that embodiments in which a liquid-handling core does not contain, nor define nor provide any portion of, a center air passage or a fan air passage that delivers air to a center air chamber or to a fan air chamber, do not necessarily preclude a surface of a liquid-handling core serving to define at least a portion of a center air chamber or a fan air chamber e.g. in the manner described above.

Those of ordinary skill will appreciate that, while the design of e.g. air horns, apertures, etc. may vary from the exemplary designs shown herein, in many embodiments an air cap may comprise at least one or more features (e.g., surfaces defining apertures) that are configured so as to be able to emit and direct at least one fan air stream upon an atomized liquid stream. As such, in such embodiments air caps are distinguished from locking rings, covers, housings, gaskets, shrouds, and the like, that do not comprise the ability to emit and direct fan air.

An air cap may be made of any suitable material, including e.g. metals, metal alloys, plastics (e.g., moldable thermoplastic polymer resins, optionally containing any suitable additives, reinforcing fillers, etc., for any desired purpose), and the like, and any combinations thereof. In some embodiments, an air cap is made of (e.g., consists of) a single unitary piece of integrally molded plastic, including e.g. the air horns, flange, and any attachment mechanism or feature that is usable to attach the air cap to a saddle. In other embodiments, an air cap may be comprised of at least two pieces that are connected to each other (e.g., a first piece comprising e.g. air horns, and a second piece comprising e.g. a ring (e.g. a locking ring with threaded connections) that is rotatably connected to the first portion and that may be used to attach the air cap e.g. to a saddle). An air cap may be provided to a user already attached to a spray head assembly; or it may be attached thereto by the user. In some embodiments, the air cap is removable from the spray gun. In further embodiments, the air cap is disposable.

Figure 2:
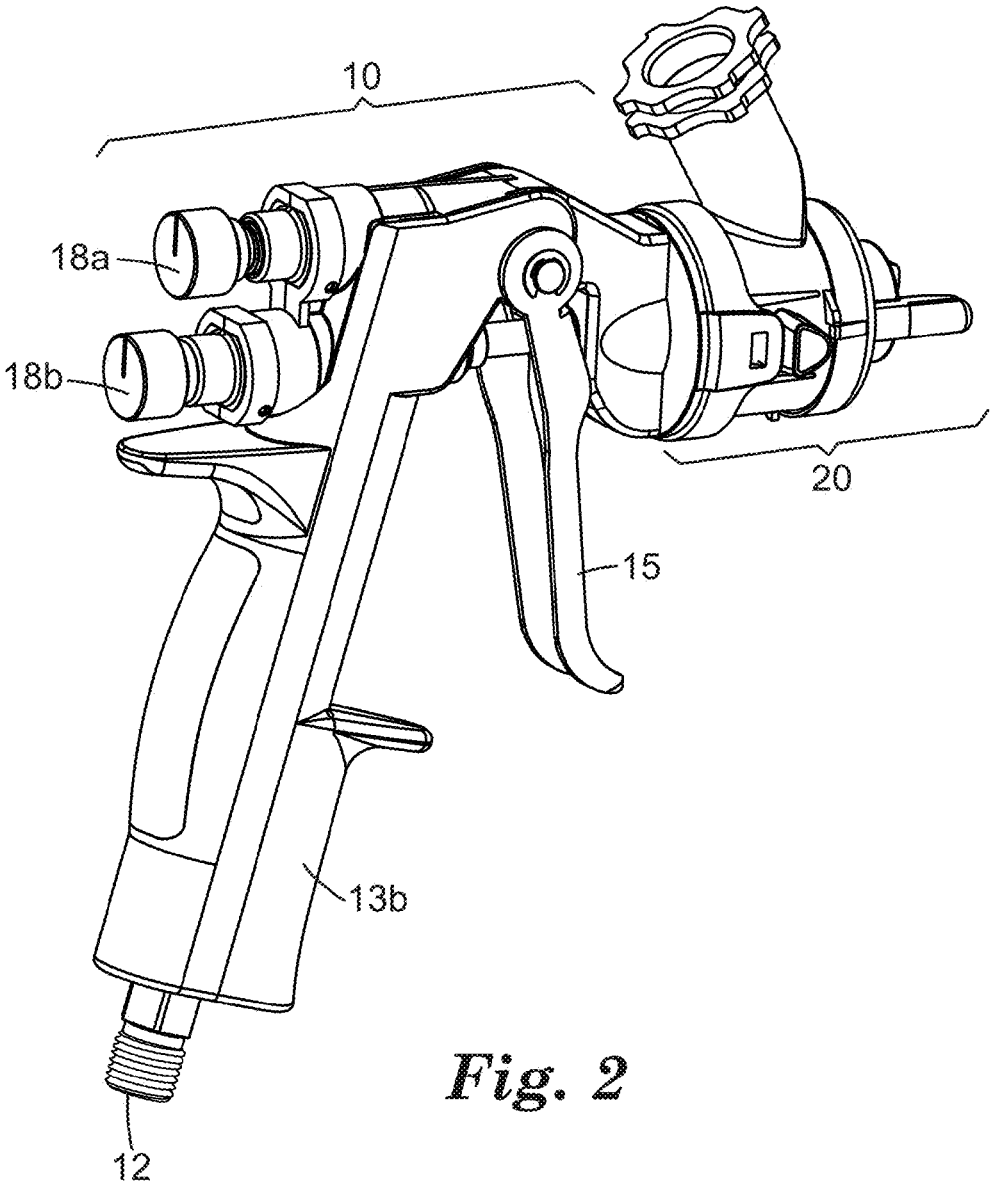
FIG. 2 is a perspective view of the liquid spray gun of FIG. 1, as assembled.

Spray head assembly 20 may be used in combination with (e.g., attached to) a liquid spray gun platform (e.g., 10) in order to form a liquid spray gun (e.g., 1), as shown in exemplary illustration in FIGS. 1 and 2. With reference to the illustrations of FIG. 1, in some embodiments this may be achieved by way of air-handling saddle 30 being attached to gun platform 10 (in specific embodiments, air-handling saddle 30 may be the only component of spray head assembly 20 that is attached to gun platform 10). In embodiments of the general type illustrated in FIGS. 1 and 2, a rear face 42 of air-handling saddle 30 may be mated to spray gun platform interface 11 of liquid spray gun platform 10, and saddle 30 attached to platform 10 by any convenient mechanism.

Attachment of a saddle to a gun platform may be releasable or non-releasable. In specific embodiments in which such attachment is releasable, an air-handling saddle may be removable and replaceable (e.g., with a new air-handling saddle which may be identical to the removed saddle, or may be different, e.g. chosen in view of the particular characteristics of the liquid to be sprayed for a given application). It will be appreciated that such replaceability may be distinguished from disposability as described earlier herein (for example, a disposable liquid-handling core might be disposed e.g. upon changing over to a different color paint, while a replaceable saddle might be replaced e.g. only upon changing a spray gun configuration (e.g. from a gravity-feed to a siphon-feed configuration)). This of course does not preclude a released saddle from being discarded if desired.

In specific embodiments in which such attachment is non-releasable, a saddle may comprise a separately-made piece which is non-releasably attached to a gun platform; or, it may be integrated a gun platform (e.g., into frame 9 of gun platform 10).

Given the above discussion, it will be appreciated that the concept of an attachable saddle broadly encompasses configurations in which a saddle is provided to a user as a component that is attachable by the user to a gun platform, as well as configurations in which a saddle as provided to the user is already attached to, or indeed integrated into, a gun platform.

Attachment of an air-handling saddle to a spray gun platform may be achieved by any suitable mechanism. For example with reference to the exemplary embodiments of FIGS. 1-4, attachment structures 39 (e.g., tabs) of saddle 30 may cooperate (e.g., mechanically interlock) with openings 11*a* and 11*b* of platform 10 to retain saddle 30 in place thereon. If the attachment is desired to be releasable such that a user in the field can release saddle 30 from platform 10, attachment structures 39 may e.g. be manually inwardly deflectable, e.g. by way applying inward pressure to stobs 139, so that they can be inwardly released from openings 11*a* and 11*b*. It will be recognized that many other releasable or non-releasable attachment techniques and/or structures, on saddle 30 and platform 10, may be used in place of those described herein, e.g., a bayonet type connection that facilitates rapid connection/disconnection of saddle 30 with a simple push or push-twist action, clamps, threaded connections, etc. In some specific embodiments, however, the attachment between saddle 30 and platform 10 is not by way of a threaded connection between the two.

With further reference to FIG. 1, exemplary spray gun platform 10 may comprise a frame 9 on which other components of platform 10 may be provided. As mentioned above, gun platform 10 may comprise at least a generally forward-facing interface 11, which is configured to mate with rear face 42 of saddle 30 as described above. Interface 11 of gun platform 10 may comprise opening 19*c* that may be configured to receive at least a rearmost section of shank 58 of hollow shaft 51 of liquid-handling core 50. Gun platform 10 may comprise a stem portion 13*a*, which may also include an optional handle 13*b* that fits over the stem portion 13*a* of gun platform 10. Handle 13*b* may, in some embodiments, be custom designed according to the operator's preference, including custom fitting by means of a thermosetting resin. Frame 9 and/or other components of spray gun platform 10 may be constructed of any suitable material that can be molded, cast, etc. to form the features described herein. Examples of some potentially suitable materials may include, e.g., metals, metal alloys, polymers (e.g., polyurethanes, polyolefins (e.g., polypropylenes), polyamides (e.g., nylons including amorphous nylons), polyesters, fluoropolymers, and polycarbonates), and others, including any combinations thereof. Selection of the materials used in gun platform 10 may be based at least in part on the compatibility of the selected materials with the liquids to be sprayed (e.g., solvent resistance and like characteristics).

Spray gun platform 10 may include needle 14 that can be used to control flow of liquid through spray gun 1. Referring to FIGS. 1 and 2, control over both air flow and liquid flow through the liquid spray gun may, in the depicted exemplary embodiment, be provided by a trigger 15 that is pivotally engaged to the spray gun platform 10 by a retaining pin 16*a* and clip 16*b* (although any other suitable connection mechanism could be used). Trigger 15 is operatively connected to needle 14, which may extend through chamber 56 within hollow shaft 51 of liquid-handling core 50, such that liquid that enters chamber 56 from liquid-handling junction 57 can then follow, through this portion of liquid-handling passage 53, a path that is generally aligned with the longitudinal axis of needle 14 and that leads to liquid-handling passage outlet 55 of liquid-handling core 50. It may be convenient to bias needle 14 (e.g., via biasing of trigger 15) to a position in which tapered front end 14*a* of needle 14 closes liquid-handling passage outlet 55 of liquid-handling core 50 (e.g., by way of tapered front end 14*a* of needle 14 contacting inward-facing surface 74 of liquid-handling passage 53 e.g. at a point at or near liquid-handling passage outlet 55). Overcoming the biasing force (e.g., by applying pressure to trigger 15) results in needle 14 being retracted and liquid being allowed to flow through liquid-handling passage 53 and out of liquid-handling passage outlet 55.

In some embodiments, tapered front end 14*a* of needle 14 does not extend forward past any portion of liquid-handling core 50 and in particular does not protrude forwardly outward of liquid-handling passage outlet 55 of core 50. Such designs may be contrasted with designs in which e.g. a significant portion of a needle extends forwardly outward from a forwardmost outlet of a liquid-handling insert of a spray gun (e.g., such that a tapered front end of the needle must contact a surface other than of the liquid-handling insert in order to prevent liquid from flowing).

In some embodiments, a needle (e.g. 14) may be attached to a gun platform so that the needle is not removable from the platform along with liquid-handling core in the act of removing the liquid-handling core from the air-handling saddle. As such, a needle can be attached to a gun platform by any suitable mechanism or device. It should be understood, however, that this requirement does not necessarily imply that the needle must be non-removably attached to the gun platform. (Such removability may be useful e.g. for maintenance, replacement of a damaged needle, etc.) Rather, such a requirement means that in ordinary operation and use of the spray gun, removing (e.g., by slidably disengaging) the liquid-handling core from the air-handling saddle does not result in the needle being detached from the gun platform and being removed therefrom along with the liquid-handling core. Such a design should be contrasted with designs in which in ordinary operation of a spray gun, a needle is removable along with (e.g., as a part of or while remaining connected to) a liquid-handling component of a spray head assembly. In further embodiments of this general type, the liquid-handling core does not include any items such as one or more springs, clips, or the like, that take part in the forward-rearward positioning or biasing of a needle and that are configured in such manner as to be removable along with the core in ordinary use of the spray gun (regardless of whether or not such items are physically contained within the body of core).

A spray gun platform (e.g. 10) may define a variety of conduits that, individually and/or in combination, supply air to the air-handling saddle of the spray head assembly. With reference to the exemplary embodiment of FIG. 1, spray gun platform 10 may include e.g. a fitting 12 such that the air supply conduit(s) in spray gun platform 10 can be connected to an air source (not shown) that supplies air to spray gun platform 10 at greater than atmospheric pressure. It may be convenient to configure gun platform 10 so that when needle 14 is in the forwardly-biased position air supply valve 17 is closed and so that trigger 15 is operatively connected to air supply valve 17 so that overcoming the biasing force to allow liquid to flow as described above, also results in air flowing through the air supply conduits of gun platform 10 and therefrom into the air-handling passages of saddle 30. Such a biasing force may be provided e.g. by a coil spring (positioned between air supply valve 17 as part of the center air control assembly 18*b*), although other biasing mechanisms may be used and those biasing mechanisms may be located in other positions (e.g., between the trigger 15 and the handle 13*b*). In the illustrated embodiment, when trigger 15 is depressed needle 14 is retracted to a position in which tapered front end 14*a* allows liquid to flow forwardly outward through liquid-handling passage outlet 55 of liquid-handling core 50. At the same time, air supply valve 17 is opened to supply air to air-handling passages of saddle 30 from the air supply conduits in spray gun platform 10. Such air flow may conveniently be in the form of fan air flow and center air flow which may be e.g. supplied through platform 10, and/or delivered through saddle 30, along separate, unconnected paths. Fan air flow may be controlled e.g. by a fan air control assembly 18*a* which controls the air supplied to fan air supply conduit outlet 19*a* of gun platform interface 11. Center air flow may be controlled e.g. by a center air control assembly 18*b* which controls air supplied to center air supply conduit outlet 19*b* of gun platform interface 11. In particular, control assembly 18*b* may control center air flow (that e.g. flows from center air orifice 72 of spray head assembly 20 and that is used to assist in atomizing the liquid emerging from liquid spray orifice 71) and control assembly 18*a* may control fan air flow (that e.g. flows from fan air apertures in air cap 140 and that is used to adjust the spray pattern geometry).

In the illustrated embodiment, center air outlet 19*b* of platform 10 may be mated to at least one inlet 31 of at least one center air passage 33 of air-handling saddle 30, so that center air can be thereby delivered (e.g., via outlet 34 of center air passage 33) into center air chamber 35 which can serve to distribute the center air into one or more center air streams arranged e.g. in radially-outward proximity to liquid-spray orifice 71 of spray head assembly 20 to facilitate the atomization of liquid emerging therefrom into a fine spray. Similarly, fan air conduit outlet 19*a* of platform 10 may be mated to at least one inlet 47*a* of at least one fan air passage 47 of air-handling saddle 30, so that fan air can be thereby delivered into fan air chamber 44 (and, e.g., hence-from into air horn cavities 145*a* and/or 145*b*) where it can help adjust the spray pattern geometry.

Although not shown in any Figure, if desired an elastomeric junction may be provided e.g. between certain portions of rear face 42 of saddle 30, and interface 11 of gun platform 10. Such elastomeric junctions may serve to reduce air leakage from e.g. the junction of center air supply conduit outlet 19*b* of platform 10, and center air passage inlet 31 of saddle 30, and/or the junction of fan air supply conduit outlet 19*a* of platform 10 and fan air passage inlet 47*a* of saddle 30. Such elastomeric junctions may be provided e.g. by one or more elastomeric gaskets or the like, that may e.g. be fastened to saddle 30 and/or gun platform 10. If desired, an elastomeric gasket may be provided around some or all of the perimeter of rear face 42 of saddle 30, to reduce overall air leakage from spray gun 1. Such an elastomeric gasket or gaskets may be conveniently provided e.g. by overmolding an elastomeric thermoplastic material over a saddle 30. Such an overmolded piece may also have portions that serve other purposes. For example, if saddle 30 comprises slits of the general type shown in FIGS. 3 and 4 (that may serve to allow inward deflection of portions of saddle 30 so that e.g. attachment tabs 39 can be radially-inwardly disengaged from slots 11*a* and 11*b* of platform 10), an overmolded elastomeric shroud or liner portion may abut the slits so as to reduce air leaks therethrough while still permitting sufficient deflection of attachment tabs 39.

In some embodiments, no portion of gun platform 10 may extend forward of the previously-mentioned liquid-handling junction 57 that fluidly connects liquid-entry passage 52 and hollow chamber 56 of liquid-handling core 50. This condition precludes not only the presence of e.g. a portion of a two-part gun platform (e.g., body) in a position forward of junction 57, but also precludes the presence, forward of junction 57, of any structural component such as one or more locking rings, locking caps, nuts, ribs, struts, and so on, that are connected to a gun platform. (In this particular context, a unitary, integrally-molded plastic air cap (e.g. 140) is not considered a structural component of a gun platform.)

In general, designs meeting this condition may include embodiments in which a liquid-handling core slidably engages (e.g., rearward) onto the front of a spray gun (e.g., into a saddle of a spray head assembly thereof). Such designs may be contrasted e.g. with designs in which a two-part (e.g., hingedly connected) gun platform (e.g., body) is opened and a component is inserted thereinto, after which the two-part gun body is closed with the component sandwiched between e.g. front and rear gun body portions such that at least a portion of the gun body is located forward of some or all portions of the component inserted thereinto. In particular embodiments of this type, there are no hinged connections between major structural parts of a spray gun platform used with the spray head assembly.

It should be understood that the above arrangements of air delivery systems and components of gun platform 10, and in particular the details of how air supply conduits of gun platform 10 may be mated to air-handling passages of saddle 30, are presented only for purposes of illustrating exemplary embodiments. The ordinary artisan will appreciate that numerous possible components and arrangements are possible, and may be used within the scope of the disclosures herein. Moreover, it will be understood in a more general sense that all of the components and arrangements of gun platform 10 discussed herein with reference to FIGS. 1 and 2 are presented only for purposes of illustrating exemplary embodiments. Any suitable design of a gun platform and of components thereof (e.g., those in which certain components are unitary with, and integrally made with, a frame, those in which certain components are separately-made pieces that are attached to a frame, those in which various components are metal, metal alloy, or plastic, etc.) may be used within the scope the disclosures described herein.

It is also noted that at least some of the embodiments disclosed herein may not require the presence of an air-handling saddle. Specifically, in embodiments of the general type in which a liquid-handling core is securable in an engaged position within a spray gun solely by the attaching of an air cap to a component of a spray gun, the engaged position may be within a gun platform (as opposed to within an air-handling saddle that is attached to a gun platform); and, the air cap may be attached to the gun platform (as opposed to attached to an air-handling saddle). For example, a liquid-handling core may be slidably engagable into a molded plastic piece of a gun platform that does not comprise any air passages. In specific embodiments, the air cap is attachable to the gun platform by way of attachment features of the air cap that are unitary with (e.g., integrally molded with) the air cap.

In accordance with the above descriptions, also disclosed herein are methods of using spray guns comprising any of the herein-disclosed features. For example, disclosed herein are methods of spraying liquids using spray guns and spray head assemblies that comprise the herein-disclosed features. Also disclosed are methods of replacing a liquid-handling core of a spray head assembly of a liquid spray gun, comprising detaching an air cap from an air-handling saddle of the spray head assembly, slidably disengaging a first liquid-handling core from the air-handling saddle and removing the core from contact with the saddle, slidably engaging a second liquid-handling core into the air-handling saddle, and attaching an air cap to the air-handling saddle. In some embodiments, such methods consist essentially of the above steps, noting that the phrase "consisting essentially of" applies to the replacing of the liquid-handling core of a spray head assembly and thus does not preclude ancillary activities such as e.g. cleaning a needle of a gun platform with which the spray head assembly is used, detaching of a paint container from the liquid-handling core, etc., but does preclude the performing of any additional steps that would be required in order to disengage and/or replace the core (e.g., removing of one or more locking rings, nuts, bolts, screws, clamps, etc., and/or opening and/or breaking apart portions of a gun platform in order to access or remove the core, and so on).

In some embodiments, the above steps may be performed in such manner that the second liquid-handling core is secured in its slidably engaged configuration within saddle solely by the attaching of the air cap to the air-handling saddle. In some embodiments, any or all of the air-handling saddle, the air cap, and the liquid-handling core may each consist of a single unitary piece of integrally molded plastic. In some embodiments, the second liquid-handling core may be different (although potentially identical in design) from the first liquid-handling core; or, it may be the same core e.g. after having been cleaned. Similarly, the air cap that is finally attached to the air-handling saddle may or may not be the same as the air cap that was originally detached from the air-handling saddle (i.e., it may be a different air cap, or it may be the same air cap after having been cleaned).

It will be appreciated that such methods may allow quick and easy changeover (e.g. to the use of a different color paint), while minimizing the number and/or expense of spray gun components that are removed and/or disposed in the changeover. However, the methods do not seek to necessarily prevent contact of a liquid with every non-removable or non-disposable surface/component of a spray gun. Rather, the methods build on the innovative realization that it may be advantageous to minimize the likelihood of the liquid coming into contact with surfaces that are difficult to clean (e.g. the inner surfaces of various air-handling passages of a saddle) while recognizing that it may in fact be easy to clean the liquid e.g. off the outer surface of a needle. Thus, in at least some embodiments a needle may be allowed to remain with a gun platform instead of being removed and/or disposed with a core, which may provide a significant cost savings. Thus in summary, in at least some embodiments the methods and apparatus disclosed herein may enable a liquid spray gun changeover that is as quick and simple as detaching an air cap from an air-handling saddle, slidably disengaging a liquid-handling core from the air-handling saddle, wiping any liquid off of the front end of the gun needle (that protrudes forwardly beyond the air-handling saddle), slidably engaging a liquid-handling core into the air-handling saddle, and attaching an air cap to the saddle.

The above-discussed illustrative embodiments have been directed in general to designs in which a liquid spray orifice of a spray head assembly (e.g., orifice 71 of FIGS. 3 and 5) is defined by surfaces of liquid-handling core 50; and, in which a center air orifice of a spray head assembly (e.g., orifice 72 of FIGS. 5 and 6) is defined by surfaces of liquid-handling core 50 and by surfaces of air cap 140 in combination. It will be appreciated that numerous variations from this design are possible, and can be implemented while remaining within the scope of the disclosures herein. For example, a liquid spray orifice and a center air orifice can both be defined by surfaces of a liquid-handling core; or, a liquid spray orifice and a center air orifice can both be defined by surfaces of an air cap. Or, a liquid spray orifice and a center air orifice can both be defined by surfaces of a component that is neither a liquid-handling core nor an air cap. Specific illustrative embodiments of such approaches will now be discussed.

Figure 7:
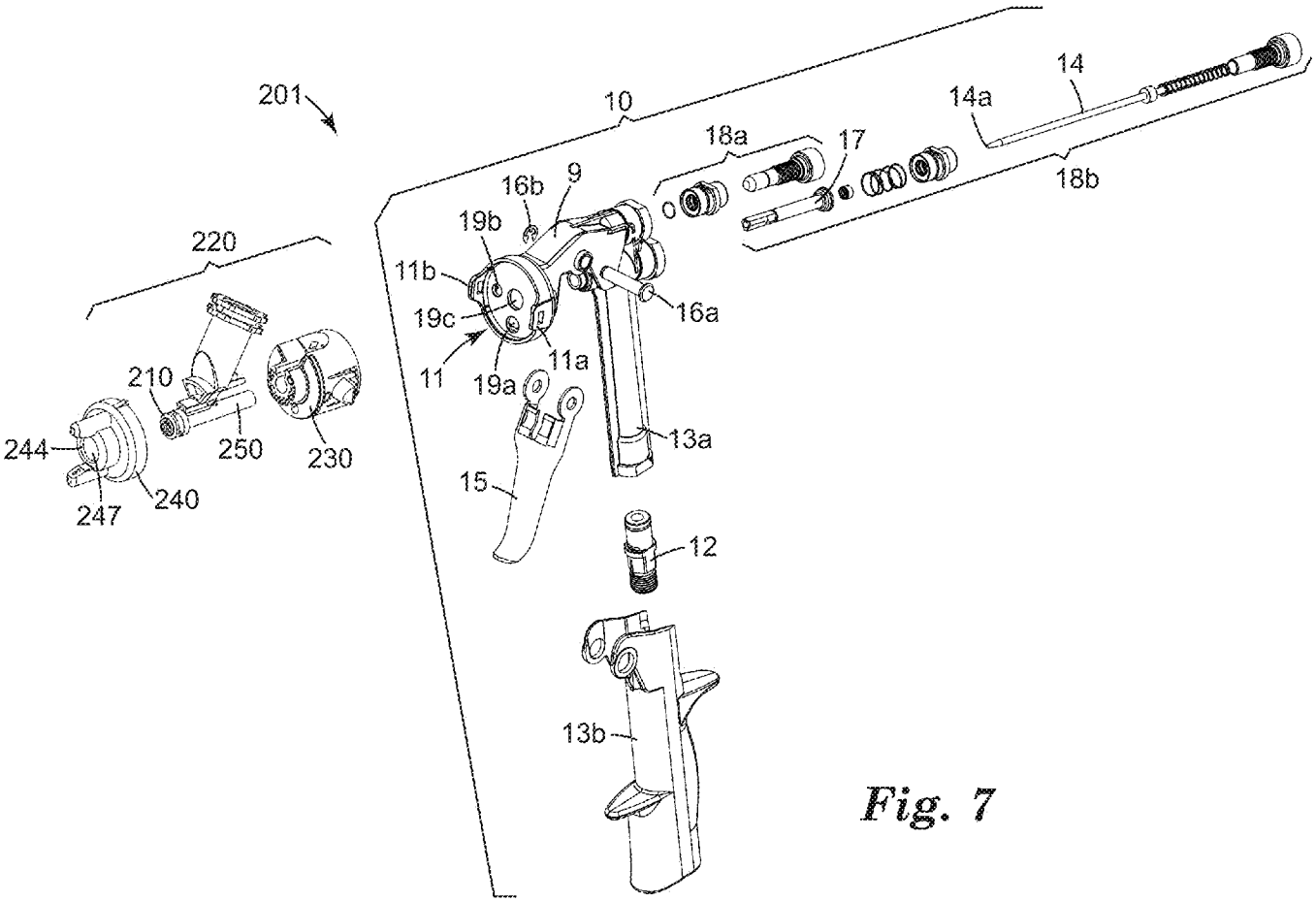
FIG. 7 is an exploded perspective view of another illustrative embodiment of a liquid spray gun, comprising a liquid-handling core with an integrated nozzle as described herein.

Shown in FIG. 7 is spray gun 201 comprising spray head assembly 220 that comprises exemplary liquid-handling core 250 that includes integrated nozzle 210 that is unitary with core 250 and may be integrally molded therewith. In alternative embodiments, a liquid-handling core with an integrated nozzle may be obtained by forming (e.g. molding), a nozzle and attaching (e.g., nonremovably attaching) it to the front end of a liquid-handling core, e.g. by snap-fitting, adhesively bonding, welding, etc. Spray head assembly 220 may comprise air-handling saddle 230, which may be similar to or identical to previously-described exemplary saddle 30, and which may be mated to gun platform 10 as described previously. Air cap 240 may be similar to previously-described air cap 140 except e.g. comprising flange 244 with an opening 247 that may be larger in diameter than previously-described opening 147 of flange 144, for purposes disclosed below. As such, many or all features and functioning of platform 10 and saddle 230, and certain features and functioning of liquid-handling core 250 and air cap 240, may be substantially similar or identical to features and functions previously described herein, and thus will not be discussed again at this point.

Figure 8:
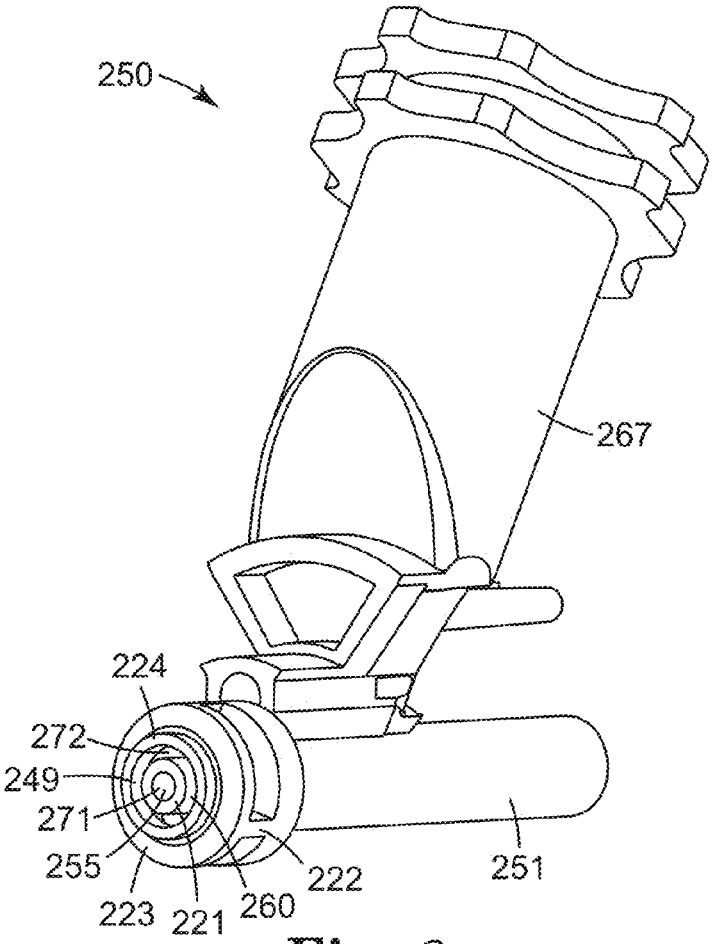
FIG. 8 is a perspective view of an exemplary liquid-handling core with an integrated nozzle.
Figure 9:
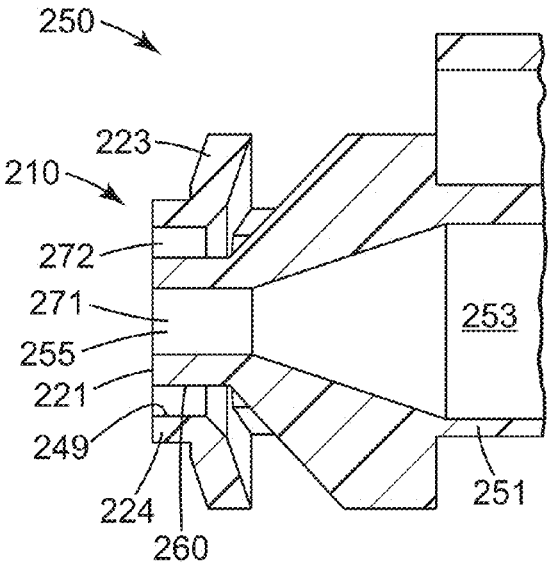
FIG. 9 is a cross-sectional view of a portion of an exemplary liquid-handling core with an integrated nozzle.

Exemplary liquid-handling core 250 including exemplary integrated nozzle 210 is shown in further detail in perspective view in FIG. 8. A cross-sectional view of a nozzle 210 and a portion of core 250 is shown in FIG. 9 (with other portions of core 250 omitted for ease of presentation). Liquid-handling core 250 may comprise hollow shaft 251 comprising liquid-handling passage 253 (e.g., generally similar to previously described hollow shaft 51 and passage 53), angled protrusion 267, and may further comprise integrated nozzle 210 at the front end of hollow shaft 251. Integrated nozzle 210 may comprise tip 221 that defines liquid-handling passage outlet 255 therein that is fluidly connected to liquid-handling passage 253 by way of a liquid-handling conduit of the integrated liquid-handling core nozzle. Thus in this embodiment outlet 255 serves as the orifice by which liquid exits liquid-handling passage 253 of core 250, and also serves as liquid spray orifice 271 of spray head assembly 220 through which liquid is emitted and atomized.

Integrated nozzle 210 may further comprise skirt 223 at least a portion of which is generally radially outwardly separated from tip 221 of integrated nozzle 210 so that integrated liquid-handling core nozzle center air conduit 272 is present therebetween. Skirt 223 may be supported e.g. by at least one rib 222 that is connected to other portions of integrated nozzle 210, as seen most easily in FIG. 8. Skirt 223 may comprise rim 224 which may at least partially annularly surround a forwardmost portion of tip 221. In the illustrated embodiment, radially-outward-facing surface 260 of tip 221 may combine with radially-inward-facing surface 249 of rim 224 of skirt 223, so that a forwardmost (outlet) portion of air conduit 272 provides the center air orifice of spray head assembly 220.

Thus, in the illustrated embodiment, center air orifice 272 and liquid spray orifice 271 of spray head assembly 220 are both defined only by surfaces of liquid-handling core 250.

In the illustrated embodiment, opening 247 of flange 244 of air cap 240 may be relatively large in diameter (e.g., compared to opening 147 of air cap 140) so as to permit integrated nozzle 210 to function as described above. That is, opening 247 may conveniently be large enough so as to not block or obscure center air orifice 272. In some embodiments, it may be useful to provide flange 244 of air cap 240 so that it overlaps e.g. a radially-outward portion of skirt 223 so that e.g. if air cap 240 is attached to saddle 230, a rearward-facing surface of flange 244 of air cap 240 may contact a forward-facing surface of skirt 223 of core 250 so as to secure core 250 in its slidably engaged position in saddle 30. However, any surface and/or portion of air cap 240 may be used for such purpose, including e.g. specially designed contact members and the like.

Other than the specific features and functions described above, spray head assembly 220 and spray gun 201 may function in similar manner to spray head assembly 20 and spray gun 1, including all possible variations discussed earlier herein.

Figure 10:
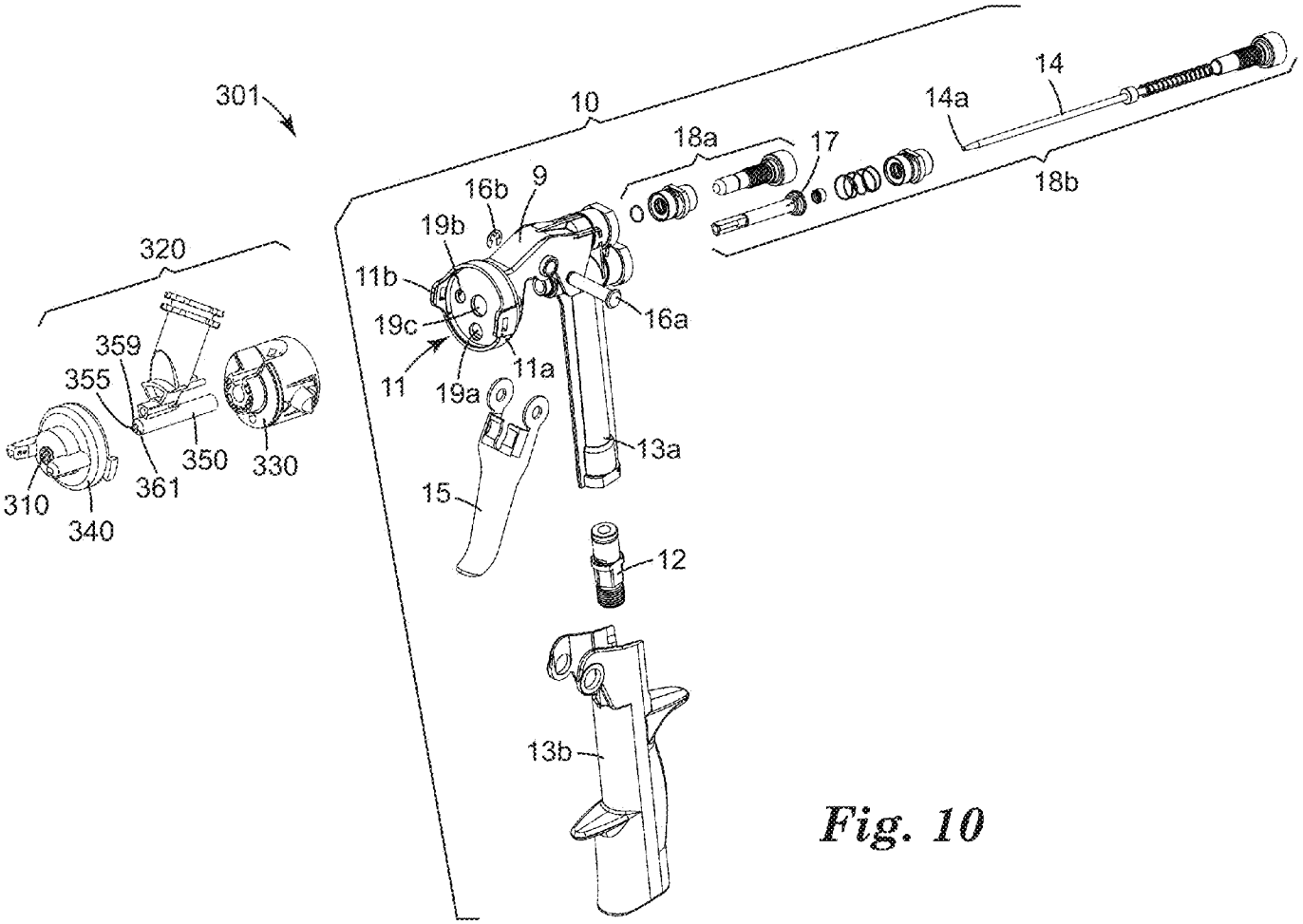
FIG. 10 is an exploded perspective view of another illustrative embodiment of a liquid spray gun, comprising an air cap with an integrated nozzle as described herein.

Shown in FIG. 10 is spray gun 301 comprising spray head assembly 320 that comprises exemplary air cap 340 that includes integrated nozzle 310 that is unitary with air cap 340 and may be integrally molded therewith. In alternative embodiments, an air cap with an integrated nozzle may be obtained by forming (e.g. molding), a nozzle and attaching (e.g., nonremovably attaching) it to an air cap, e.g. by snap-fitting, adhesively bonding, welding, etc. Spray head assembly 320 may comprise air-handling saddle 330, which may be similar to or identical to previously-described exemplary saddle 30, and which may be mated to gun platform 10 as described previously. Spray head assembly 320 may comprise liquid-handling core 350, which may e.g. be similar or identical to previously-described exemplary core 50, except for e.g. certain differences as may be present for purposes described below. As such, many or all features and functioning of platform 10 and saddle 330, and certain features and functioning of liquid-handling core 350 and air cap 340, may be substantially similar or identical to corresponding features and functions previously described herein, and thus will not be discussed again at this point.

Figure 11:
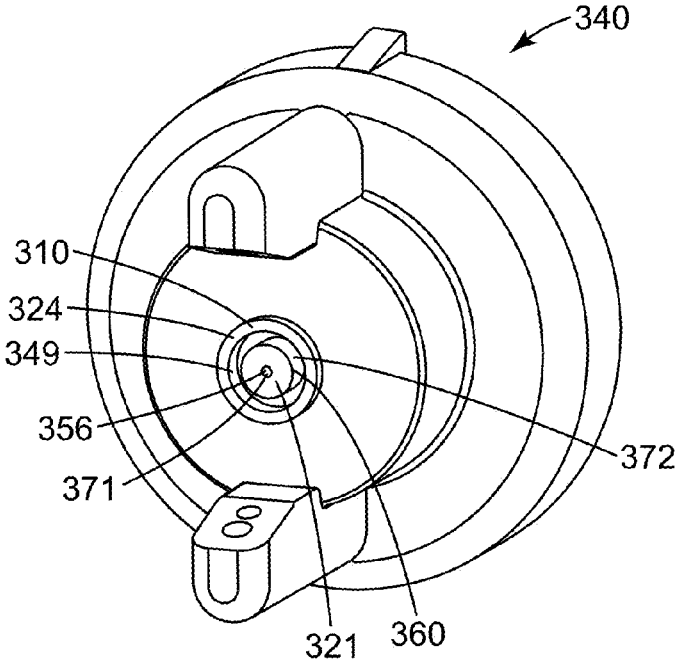
FIG. 11 is a perspective view of an exemplary air cap with an integrated nozzle.
Figure 12:
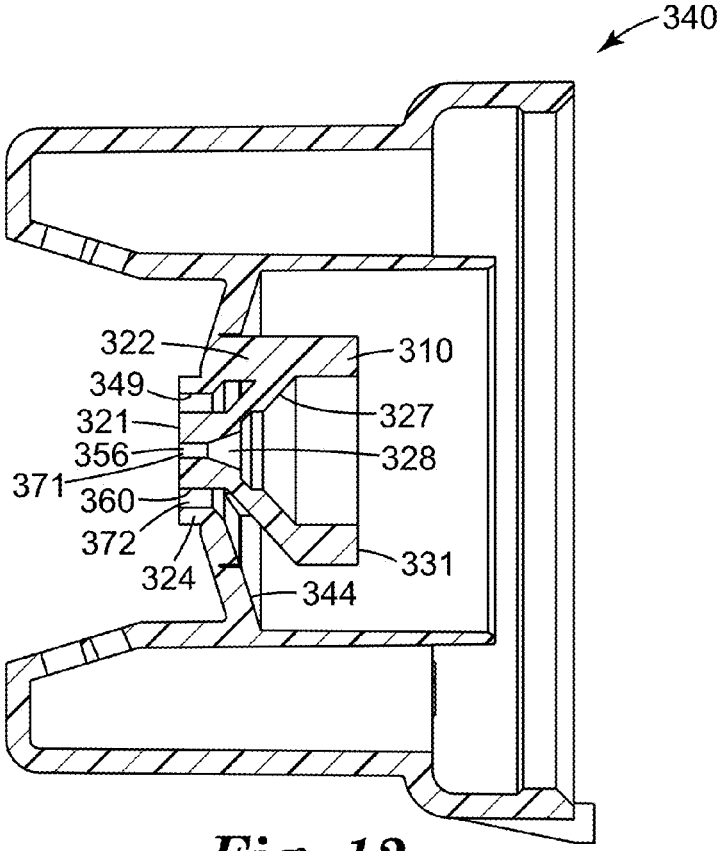
FIG. 12 is a cross-sectional view of an exemplary air cap with an integrated nozzle.

Exemplary air cap 340 including exemplary integrated nozzle 310 is shown in further detail in perspective view in FIG. 11, and in cross-sectional view in FIG. 12. Air cap 340 may share various features (e.g., air horns etc.) with previously-described air cap 140; such features will not be discussed again at this point. Air cap 340 includes integrated nozzle 310, which may be e.g. connected to, and supported by, flange 344 of air cap 340 (e.g. by way of at least one rib 322), although any convenient method of incorporating nozzle 310 into air cap 340 and supporting it therein can be used. Integrated nozzle 310 may comprise radially inwardmost tip 321 that defines liquid portal (outlet) 356 that is fluidly connected to throat 328 that is fluidly connected to an open end of rear face 331 of integrated nozzle 310 (with at least portal 356 and throat 328 comprising a liquid-handling conduit of integrated air cap nozzle). In the illustrated embodiment, when spray head assembly 320 is assembled, forward tip 359 of liquid-handling core 350 may reside within the open end of rear face 331 of integrated nozzle 310, so that liquid that exits liquid-handling passage outlet 355 of core 350 is deposited into throat 328 wherefrom it may pass forwardly outward through liquid portal 356 of integrated nozzle 310. If desired, forward and/or radially-outward facing surface 361 of core tip 359 may be contacted with e.g. seating surface 327 of open end of rear face 331 of integrated nozzle 310 so that a generally liquid-tight connection may be attained between core 350 and nozzle 310. The shape of forward tip 359 and/or any other features thereof may be varied (e.g., from the exemplary configuration of forward tip 59 of core 50 as shown e.g. in FIGS. 3 and 5) so as to most optimally mate with open end of rear face 331 of integrated nozzle 310. Of course, seating surface 327 and any other surfaces of nozzle 310 may also be designed for optimal liquid-tight mating with core tip 359.

Air cap 340 may also comprise annular rim 324. Radially-inward-facing surface 349 of rim 324 may combine with radially-outward-facing surface 360 of tip 321 so as to provide integrated air cap nozzle center air conduit 372, which may comprise e.g. a rear portion that may receive air (e.g., from a center air chamber) and a forwardmost (outlet) portion that provides the center air orifice of spray head assembly 320. Thus, in this embodiment center air orifice 372 is defined by surfaces of air cap 340.

In this embodiment liquid portal 356 of integrated nozzle 310 of air cap 340 serves as liquid spray orifice 371 of spray head assembly 320 through which liquid is emitted and atomized. Thus in the illustrated embodiment, center air orifice 372 and liquid spray orifice 371 of spray head assembly 320 are both defined only by surfaces of air cap 340.

It may be convenient that the contacting of surface 327 of integrated nozzle 310 with some portion of forward tip 359 of core 350, acts to secure core 350 in its slidably engaged position in saddle 330. However, any surface and/or portion of air cap 340 may be used for such purpose, including e.g. specially designed contact members and the like.

Other than the specific features and functions described above, spray head assembly 320 and spray gun 301 may function in similar manner to spray head assembly 20 and spray gun 1, including all possible variations discussed earlier herein.

It will be appreciated that a design with an air cap with an integrated nozzle (with a throat into which liquid is received and a portal through which liquid exits) is a specific exception to the earlier-described condition in which substantially no interior surface of any component of a spray head assembly is contacted by liquid except for surfaces of a liquid-handling passage of a liquid-handling core. This distinction notwithstanding, it is readily apparent that even in such cases, substantially no surfaces of air-handling saddle 330 may be contacted by liquid in ordinary operation of spray gun 301. Thus, this particular design still shares many of the advantages discussed earlier herein and may merely make it more advantageous for air cap 340 to be disposable.

Further details of air caps with integrated nozzles can be found in U.S. Provisional Patent Application Ser. No. 61/512,678, filed Jul. 28, 2011, entitled Spray Head Assembly with Integrated Air Cap/Nozzle for a Liquid Spray Gun, which is incorporated by reference in its entirety herein.

Figure 13:
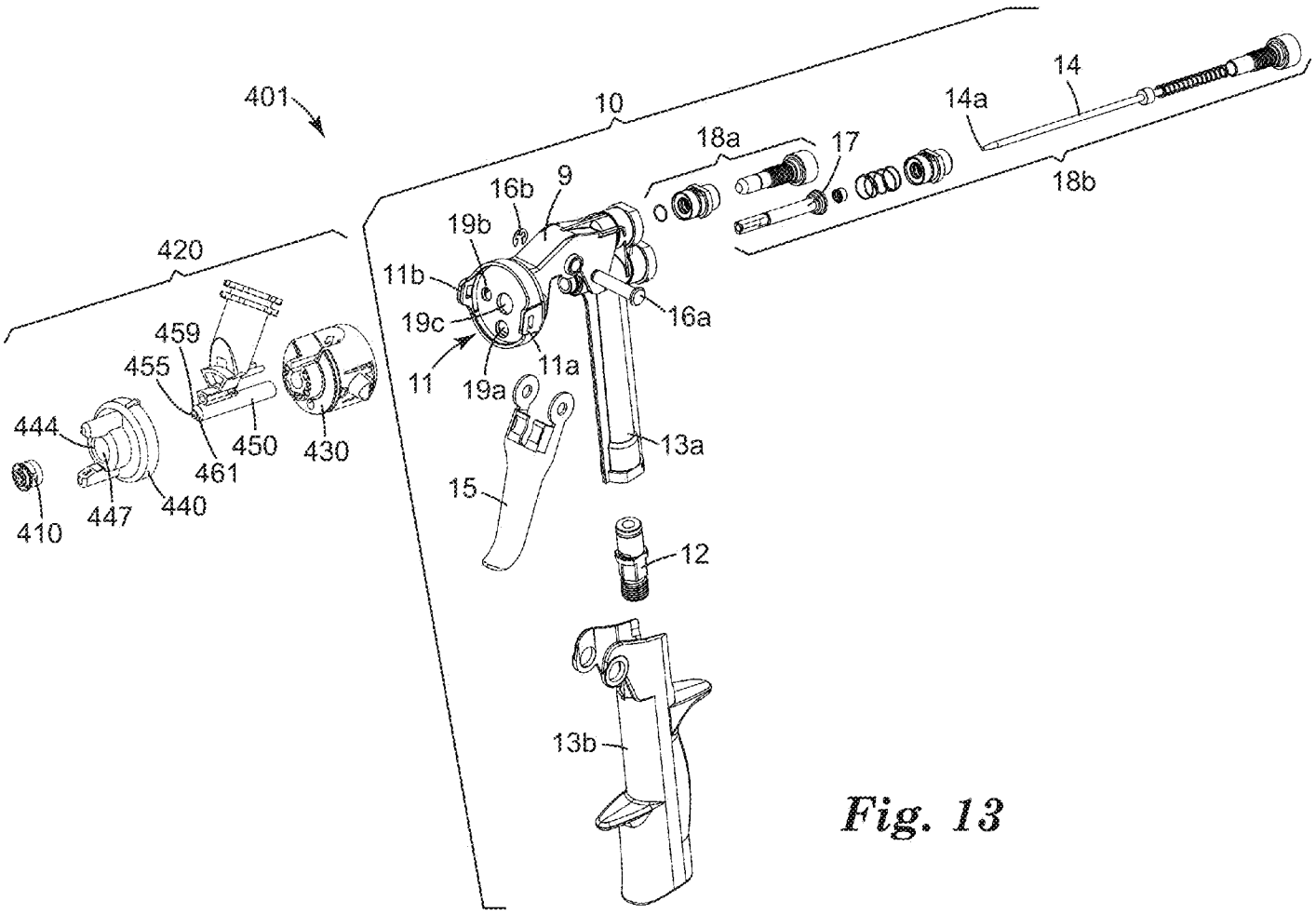
FIG. 13 is an exploded perspective view of another illustrative embodiment of a liquid spray gun, comprising a nozzle insert as described herein.

Shown in FIG. 13 is exemplary spray gun 401 comprising exemplary spray head assembly 420 that comprises nozzle insert 410. Spray head assembly 420 may comprise air-handling saddle 430, which may be similar to or identical to previously-described exemplary saddle 30, and which may be mated to gun platform 10 as described previously. Spray head assembly 420 may comprise liquid-handling core 450, which may e.g. be similar or identical to previously-described exemplary core 50, except for e.g. certain differences as may be present for purposes described below. Air cap 440 may be similar to previously-described air cap 140 except e.g. comprising flange 444 with an opening 447 that may be larger in diameter than previously-described opening 147 of flange 144, for purposes disclosed below. As such, many or all features and functioning of platform 10 and saddle 430, and certain features and functioning of liquid-handling core 450 and air cap 440, may be substantially similar or identical to corresponding features and functions previously described herein, and thus will not be discussed again at this point.

Figure 14:
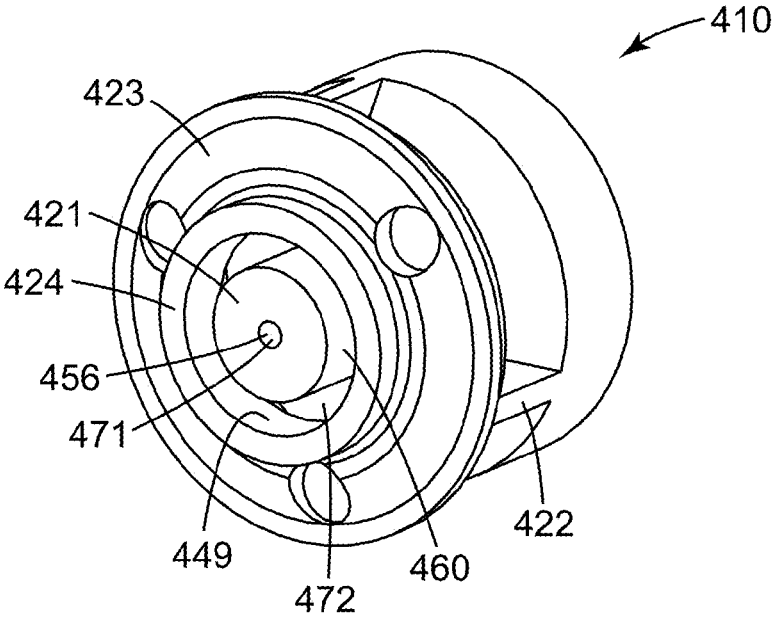
FIG. 14 is a perspective view of an exemplary nozzle insert.
Figure 15:
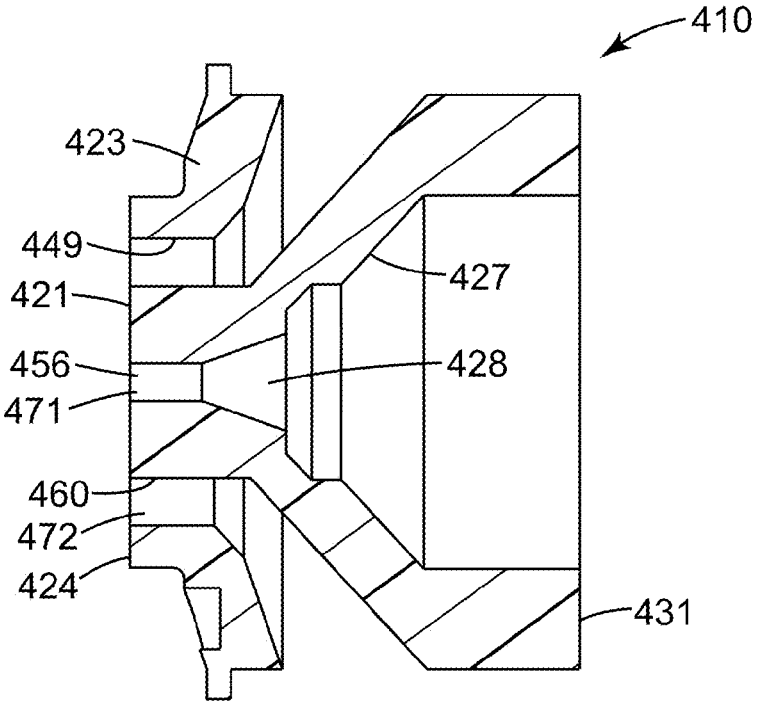
FIG. 15 is a cross-sectional view of an exemplary nozzle insert.

Exemplary nozzle insert 410 is shown in further detail in perspective view in FIG. 14, and in cross-sectional view in FIG. 15. Nozzle insert 410 may be e.g. a single unitary piece of integrally molded plastic, and may be designed to be positioned (e.g., sandwiched as discussed in further detail below) between air cap 440 and liquid-handling core 450.

Nozzle insert 410 may comprise radially inwardmost tip 421 that defines liquid portal (outlet) 456 that is fluidly connected to throat 428 that is fluidly connected to an open end of rear face 431 of nozzle insert 410 (with at least portal 456 and throat 428 comprising a liquid-handling conduit of nozzle insert 410). In the illustrated embodiment, when spray head assembly 420 is assembled, forward tip 459 of liquid-handling core 450 may reside within the open end of rear face 431 of integrated nozzle 410, so that liquid that exits liquid-handling passage outlet 455 of core 450 is deposited into throat 428 wherefrom it may pass forwardly outward through liquid portal 456 of integrated nozzle 410. If desired, forward and/or radially-outward facing surface 461 of core tip 459 may be contacted with e.g. seating surface 427 of open end of rear face 431 of integrated nozzle 410 so that a generally liquid-tight connection may be attained between core 450 and nozzle insert 410. The shape of forward tip 459 and/or any other features thereof may be varied (e.g., from the exemplary configuration of forward tip 59 of core 50 as shown e.g. in FIGS. 3 and 5) so as to most optimally mate with open end of rear face 431 of integrated nozzle 410. Of course, seating surface 427 and any other surfaces of nozzle insert 410 may also be designed for optimal liquid-tight mating with core tip 459.

Nozzle insert 410 may further comprise skirt 423 at least a portion of which is generally radially outwardly separated from tip 421 of nozzle insert 410 so that nozzle insert center air conduit 472 is present therebetween. Skirt 423 may be supported e.g. by at least one rib 422 that is connected to other portions of integrated nozzle 410, as seen most easily in FIG. 14. Skirt 423 may comprise rim 424 which may at least partially annularly surround a forwardmost portion of tip 421. In the illustrated embodiment, radially-outward-facing surface 460 of tip 421 may combine with radially-inward-facing surface 449 of rim 424 of skirt 423, so that a forwardmost (outlet) portion of center air conduit 472 provides the center air orifice of spray head assembly 420. A rear portion of conduit 472 may receive air (e.g., from a center air chamber). Thus, in this embodiment center air orifice 472 is defined by surfaces of nozzle insert 410.

In this embodiment liquid portal 456 of nozzle insert 410 serves as liquid spray orifice 471 of spray head assembly 420 through which liquid is emitted and atomized. Thus in the illustrated embodiment, center air orifice 472 and liquid spray orifice 471 of spray head assembly 420 are both defined only by surfaces of nozzle insert 410.

In the illustrated embodiment opening 447 of flange 444 of air cap 440 may be relatively large in diameter (e.g., compared to opening 147 of air cap 140) so as to permit nozzle insert 410 to function as described above. That is, opening 447 may conveniently be large enough so as to not block or obscure center air orifice 472. In some embodiments, it may be useful to provide flange 444 of air cap 440 so that it overlaps e.g. a radially-outward portion of skirt 423 of nozzle insert 410 so that e.g. if air cap 440 is attached to saddle 430, a rearward-facing surface of flange 444 of air cap 440 may contact a forward-facing surface of skirt 423 so as to hold nozzle insert 410 in a desired location. However, any surface and/or portion of air cap 240 may be used for such purpose, including e.g. specially designed contact members and the like.

In other embodiments, a nozzle insert may be held in place by some mechanism other than by being held in place by an air cap in the manner described above. For example, a nozzle insert may be attachable (e.g., threadably attachable) to a liquid-handling core. In some embodiments of this general type, opening 447 of air cap 440 may be sized so that the nozzle insert can be inserted therethrough and attached e.g. to a liquid-handling core (in such embodiments, a nozzle insert can be positioned in place, and/or attached to, a spray head assembly, after and/or independently of the attaching of an air cap to the spray head assembly). In particular embodiments of this type, a rear-facing surface of a component of the nozzle insert (e.g., of skirt 423 of nozzle insert 410) may face and/or contact a forward-facing surface of flange 444 of air cap 440.

In some embodiments, the contacting of surface 427 of nozzle insert 410 with some portion of forward tip 459 of core 450, may act to secure core 450 in its slidably engaged position in saddle 430. However, any surface and/or portion of nozzle insert 410 may be used for such purpose, including e.g. specially designed contact members and the like. It should be appreciated however that nozzle insert 410 is not considered to be a structural component of gun platform 10.

It will be appreciated that in some embodiments air cap 440 may be attached to saddle 430 in such manner that air cap 440 applies pressure to nozzle insert 410, which in turn applies pressure to core 450. In such embodiments the attaching of air cap 440 to saddle 430 may achieve both the aforementioned securing of core 450 in its slidably engaged position in saddle 430, and the holding of nozzle insert 410 securely in its desired position. In other embodiments, nozzle insert 410 may be attached (e.g., removably attached) to either air cap 440 or core 450, which may serve to hold nozzle insert 410 in its desired position. Such attachment may be by way of a threaded connection between the insert and the air cap or core; a friction-fit; or, e.g. any other suitable method of removable attachment.

Other than the specific features and functions described above, spray head assembly 420 and spray gun 401 may function in similar manner to spray head assembly 20 and spray gun 1, including all possible variations discussed earlier herein.

It will be appreciated that a design with a nozzle insert (with a throat into which liquid is received and a portal through which liquid exits) is another specific exception to the earlier-described condition in which substantially no interior surface of any component of a spray head assembly is contacted by liquid except for surfaces of a liquid-handling passage of a liquid-handling core. The earlier-described condition can thus be qualified as meaning that substantially no interior surface of any component of a spray head assembly is contacted by liquid except for surfaces of a liquid-handling passage of a liquid-handling core; and, in the special case of an air cap with an integrated nozzle, surfaces of the air cap; and, in the special case of a nozzle insert, surfaces of the nozzle insert.

Such distinctions notwithstanding, it is readily apparent that even in such cases, substantially no surfaces of air-handling saddle 430 may be contacted by liquid in ordinary operation of spray gun 401. Thus, this particular design still shares many of the advantages discussed earlier herein and may merely provide an advantageous ability to pick and choose a nozzle insert as desired in a particular circumstance.

Further details of nozzle inserts can be found in U.S. Provisional Patent Application Ser. No. 61/440,950, filed Feb. 9, 2011, entitled Nozzle Tips and Spray Head Assemblies for Liquid Spray Guns, which is incorporated by reference in its entirety herein.

Fluid-handling cores with integrated nozzles (e.g., exemplary core 250), air caps with integrated nozzles (e.g., exemplary air cap 340), and nozzle inserts (e.g., nozzle insert 410) may be made of any suitable material, including e.g. metals, metal alloys, plastics (e.g., moldable thermoplastic polymer resins, optionally containing any suitable additives, reinforcing fillers, etc., for any desired purpose), and the like, and any combinations thereof.

LIST OF EXEMPLARY EMBODIMENTS

Embodiment 1. A spray head assembly for use with a liquid spray gun platform, comprising: an air-handling saddle that is attachable to the liquid spray gun platform, an air cap that is attachable to the air-handling saddle, and a liquid-handling core that is slidably engagable into the air-handling saddle.

Embodiment 2. The spray head assembly of embodiment 1 wherein the liquid-handling core is securable in its engaged position within the air-handling saddle by the attaching of the air cap to the air-handling saddle.

Embodiment 3. The spray head assembly of any of embodiments 1-2 wherein the air-handling saddle consists of a unitary piece of integrally molded plastic that comprises at least one center air passage and at least one fan air passage.

Embodiment 4. The spray head assembly of any of embodiments 1-3 wherein the liquid-handling core consists of a unitary piece of molded plastic that is removable from the saddle and that is disposable; and, wherein the liquid-handling core does not include a needle that is removable from the liquid spray gun platform along with the liquid-handling core; wherein the liquid-handling core does not include, or provide any part of, a center air passage or a fan air passage; and, wherein a liquid-handling passage of the liquid-handling core comprises a liquid-handling junction that fluidly connects a liquid-entry passage that is within a hollow protrusion that protrudes generally radially outward from a hollow shaft of the liquid-handling core, to an elongate chamber within the hollow shaft of the liquid-handling core, and wherein when the core is slidably engaged into the air-handling saddle and the air-handling saddle is attached to the liquid spray gun platform, no part of the liquid spray gun platform is located forward of the liquid-handling junction of the liquid-handling passage of the liquid-handling core.

Embodiment 5. The spray head assembly of any of embodiments 1-4 wherein the spray head assembly comprises a nozzle insert comprising: a nozzle insert liquid-handling conduit configured to receive liquid exiting the liquid-handling passage outlet of the liquid-handling core and fluidly connected to a nozzle insert liquid-handling conduit portal that provides a liquid spray orifice of the spray head assembly; and, at least one nozzle insert center air conduit configured to receive air exiting the at least one center air passage of the saddle and fluidly connected to a nozzle insert center air conduit outlet that provides a center air orifice of the spray head assembly.

Embodiment 6. The spray head assembly of any of embodiments 1-4 wherein the air cap comprises an integrated air cap nozzle comprising: an integrated air cap nozzle liquid-handling conduit configured to receive liquid exiting the liquid-handling passage outlet of the liquid-handling core and fluidly connected to an integrated nozzle liquid-handling conduit portal that provides a liquid spray orifice of the spray head assembly; and, at least one integrated air cap nozzle center air conduit configured to receive air exiting the at least one center air passage of the saddle and fluidly connected to an integrated air cap nozzle center air conduit outlet that provides a center air orifice of the spray head assembly.

Embodiment 7. The spray head assembly of any of embodiments 1-4 wherein the liquid-handling core comprises an integrated liquid-handling core nozzle comprising: an integrated liquid-handling core nozzle liquid-handling conduit that is fluidly connected to an outlet that provides a liquid spray orifice of the spray head assembly; and, at least one integrated liquid-handling core nozzle center air conduit configured to receive air exiting the at least one center air passage of the saddle and fluidly connected to an integrated liquid-handling core nozzle center air outlet that provides a center air orifice of the spray head assembly Embodiment 8. The spray head assembly of any of embodiments 1-7 wherein the saddle is detachably attachable to the liquid spray gun platform.

Embodiment 9. The spray head assembly of any of embodiments 1-7 wherein the saddle is non-detachably attached to the liquid spray gun platform.

Embodiment 10. The spray head assembly of any of embodiments 1-9 wherein the air cap is a unitary piece of integrally molded plastic that comprises two air horns that project forward past a liquid-handling passage outlet of the liquid-handling core and that collectively comprise apertures located on opposite sides of an axis generally aligned with a direction of liquid flow through the liquid-handling passage outlet of the liquid-handling core.

Embodiment 11. The spray head assembly of any of embodiments 1-10 wherein the air cap is a unitary piece of integrally molded plastic and the air cap is attachable to the saddle by way of attachment features of the air cap that are unitary with, and integrally molded with, the air cap.

Embodiment 12. The spray head assembly of any of embodiments 1-4 and 8-11 wherein a liquid-handling passage outlet of a liquid-handling passage of the liquid-handling core provides a liquid spray orifice of the spray head assembly; and, wherein a generally radially-outward-facing surface of a portion of the liquid-handling core that is proximal to the liquid-handling passage outlet, and a generally radially-inward-facing surface of an opening in a flange of the air cap, collectively provide a center air orifice of the spray head assembly.

Embodiment 13. The spray head assembly of any of embodiments 1-12 wherein the liquid-handling core comprises a hollow shaft comprising: an elongate interior chamber at least a portion of which comprises at least a forwardmost portion of the liquid-handling passage of the liquid-handling core; and, a longitudinal axis that is generally aligned with the direction of liquid flow through the elongate interior chamber of the hollow shaft; and wherein the liquid handling core is slidably engageable into the saddle in a direction toward the rear of the spray head assembly, along an axis generally aligned with a longitudinal axis of the hollow shaft of the liquid handling core.

Embodiment 14. The spray head assembly of embodiment 13 wherein the liquid handling core comprises a hollow, angled protruding portion that: protrudes outward at an angle from the hollow shaft of the liquid-handling core; comprises the liquid-handling passage inlet of the core; and, comprises a liquid-entry passage that is fluidly connected to the liquid-handling passage inlet of the core and that is fluidly connected, by way of a liquid-handling junction, to the elongate interior chamber of the hollow shaft of the liquid-handling core.

Embodiment 15. The spray head assembly of any of embodiments 13 and 14 wherein the saddle comprises: at least one center air passage that extends from a center air passage inlet to a center air passage outlet; at least one fan air passage that extends from a fan air passage inlet to a fan air passage outlet; and, an elongated cavity that extends through a longitudinal extent of the saddle from a rearmost end of the saddle to a forwardmost end of the saddle and that is configured to slidably receive at least the hollow shaft of the liquid-handling core.

Embodiment 16. The spray head assembly of any of embodiments 1-15 wherein when the liquid-handling core is in its slidably engaged position within the air-handling saddle, the core and saddle collectively provide a center air delivery annulus and a fan air delivery annulus, and wherein when the air cap is attached to the saddle: the center air delivery annulus provided by the core and saddle combines with at least some surfaces of the air cap to at least partially define a center air chamber that is configured to distribute center air to a center air orifice of the spray head assembly; and, the fan air delivery annulus provided by the core and saddle combines with at least some surfaces of the air cap to provide a fan air chamber that is configured to distribute fan air to at least two air horns that project forward past a liquid handling passage outlet of the liquid-handling core.

Embodiment 17. The spray head assembly of any of embodiments 1-16 wherein the liquid-handling core comprises at least one liquid-handling core registration feature that is configured to slidably engage with, and mate to, at least one air-handling saddle registration feature when the liquid-handling core is slidably engaged into the air-handling saddle.

Embodiment 18. The spray head assembly of embodiment 17 wherein the liquid-handling core registration feature and the air-handling saddle registration feature are configured to slidably engage with each other along an axis that is generally parallel to a longitudinal axis of a hollow shaft of the liquid handling core, in a manner that does not prevent the liquid-handling core from being slidably disengaged from the air-handling saddle.

Embodiment 19. The spray head assembly of any of embodiments 1-18 wherein the liquid-handling core is slidably engagable into the air-handling saddle in a rearward direction along an axis that is generally aligned with a longitudinal axis of a hollow shaft of the liquid-handling core.

Embodiment 20. The spray head assembly of any of embodiments 1-19 wherein when the liquid-handling core is in its engaged position within the air-handling saddle, all surfaces of the liquid-handling core and of the air-handling saddle, in areas of contact between surfaces of the liquid-handling core and the air-handling saddle, are hard surfaces.

Embodiment 21. The spray head assembly of any of embodiments 1-20 wherein the liquid-handling core is removable and disposable.

Embodiment 22. A spray gun comprising the spray head assembly of any of embodiments 1-21 attached to a liquid spray gun platform.

Embodiment 23. A method of spraying a liquid, wherein the method uses the spray gun of embodiment 22.

Embodiment 24. A method of changing a liquid-handling core of a spray head assembly, comprising: detaching an air cap from an air-handling saddle of the spray head assembly; slidably disengaging a first liquid-handling core from the air-handling saddle and removing the core from contact with the saddle, slidably engaging a second liquid-handling core into the air-handling saddle; and, attaching an air cap to the air-handling saddle Embodiment 25. The method of embodiment 24 wherein the second liquid-handling core is secured in place in the air-handling saddle by the attaching of the air cap to the air-handling saddle.

Embodiment 26. The method of any of embodiments 24-25 where the spray head assembly comprises the spray head assembly of any of embodiments 1-21.

Embodiment 27. A spray gun comprising a liquid-handling core that is slidably engagable into a gun platform of the spray gun and an air cap that is attachable to the gun platform, wherein the liquid-handling core is securable in its engaged position within the gun platform by the attaching of the air cap to the gun platform.

Embodiment 28. A kit comprising a plurality of disposable liquid-handling cores that are configured for use with the spray head assembly of any of embodiments 1-21, with the spray guns of any of embodiments 22 and 27, and with the methods of embodiments 23-26.

Embodiment 29. A kit comprising a plurality of replaceable air-handling saddles that are configured for use with the spray head assembly of any of embodiments 1-21, with the spray guns of any of embodiments 22 and 27, with the methods of embodiments 23-26, and with the liquid-handling cores of embodiment 28.

Illustrative embodiments of liquid-handling cores, air-handling saddles, air caps, the assembly of these components into spray head assemblies, the interfacing of such assemblies to spray gun platforms to form spray guns, etc., have been discussed and reference has been made to possible variations. It will be apparent to those skilled in the art that the specific exemplary structures, features, details, configurations, etc., that are disclosed herein can be modified and/or combined in numerous embodiments. All such variations and combinations are contemplated by the inventor as being within the bounds of the conceived invention. Thus, the scope of the present invention should not be limited to the specific illustrative structures described herein, but rather extends at least to the structures described by the language of the claims, and the equivalents of those structures. As used herein, the term "liquid" refers to all forms of flowable materials that can be applied to a surface using a spray gun or other spray apparatus (whether or not they are intended to color the surface) including (without limitation) paints, primers, base coats, lacquers, varnishes and similar paint-like materials, as well as other materials such as, e.g., adhesives, sealers, fillers, putties, powder coatings, blasting powders, abrasive slurries, agricultural liquids/solutions (e.g., fertilizers, herbicides, insecticides, etc.), mold release agents, foundry dressings, etc. which may, in some embodiments, be applied in atomized form depending on the properties and/or the intended application of the material. The term "liquid" is to be construed accordingly. The term "air" is used for convenience and broadly encompasses the use of any suitable gaseous composition or mixture (e.g., nitrogen, inert gases, and so on). The term "atomize" is likewise used for convenience to refer to transforming a liquid into a fine spray and does not require transforming the liquid into individual molecules or atoms. As used herein as a modifier to a property or attribute, the term "generally" means that the property or attribute would be readily recognizable by a person of ordinary skill but without requiring absolute precision or a perfect match (e.g., within +/−20% for quantifiable properties); the term "substantially" means to a high degree of approximation (e.g., within +/−5% for quantifiable properties) but again without requiring absolute precision or a perfect match. To the extent that there is a conflict or discrepancy between this specification as written and the disclosure in any document incorporated by reference herein, this specification as written will control.

What is claimed is:

1. A spray head assembly for use with a liquid spray gun platform, comprising:

an air-handling saddle that is attachable to the liquid spray gun platform;

an air cap that is attachable to the air-handling saddle;

a liquid-handling core that is slidably engagable into the air-handling saddle in a direction from a forwardmost end toward a rearwardmost end of the air-handling saddle, the liquid-handling core comprising a protruding portion comprising a liquid-handling passage inlet to mate with a separate container containing a liquid to be sprayed, wherein the liquid-handling core does not comprise any center air or fan air passages leading through any portion of the liquid-handling core.

2. The spray head assembly of claim 1 wherein the saddle is detachably attachable to the liquid spray gun platform.

3. The spray head assembly of claim 1 wherein the saddle is non-detachably attached to the liquid spray gun platform.

4. The spray head assembly of claim 1 wherein the air cap is a unitary piece of integrally molded plastic that comprises two air horns that project forward past a liquid-handling passage outlet of the liquid-handling core and that collectively comprise apertures located on opposite sides of an axis generally aligned with a direction of liquid flow through the liquid-handling passage outlet of the liquid-handling core.

5. The spray head assembly of claim 1 wherein the air cap is a unitary piece of integrally molded plastic and the air cap is attachable to the saddle by way of attachment features of the air cap that are unitary with, and integrally molded with, the air cap.

6. The spray head assembly of claim 1 wherein a liquid-handling passage outlet of a liquid-handling passage of the liquid-handling core provides a liquid spray orifice of the spray head assembly; and, wherein a generally radially-outward-facing surface of a portion of the liquid-handling core that is proximal to the liquid-handling passage outlet, and a generally radially-inward-facing surface of an opening in a flange of the air cap, collectively provide a center air orifice of the spray head assembly.

7. The spray head assembly of claim 1 wherein the spray head assembly comprises a nozzle insert comprising:

a nozzle insert liquid-handling conduit configured to receive liquid exiting a liquid-handling passage outlet of the liquid-handling core and fluidly connected to a nozzle insert liquid-handling conduit portal that provides a liquid spray orifice of the spray head assembly; and at least one nozzle insert center air conduit configured to receive air exiting at least one center air passage of the saddle and fluidly connected to a nozzle insert center air conduit outlet that provides a center air orifice of the spray head assembly.

8. The spray head assembly of claim 1 wherein the air cap comprises an integrated air cap nozzle comprising:

an integrated air cap nozzle liquid-handling conduit configured to receive liquid exiting a liquid-handling passage outlet of the liquid-handling core and fluidly connected to an integrated nozzle liquid-handling conduit portal that provides a liquid spray orifice of the spray head assembly; and at least one integrated air cap nozzle center air conduit configured to receive air exiting at least one center air passage of the saddle and fluidly connected to an integrated air cap nozzle center air conduit outlet that provides a center air orifice of the spray head assembly.

9. The spray head assembly of claim 1 wherein the liquid-handling core comprises an integrated liquid-handling core nozzle comprising:

an integrated liquid-handling core nozzle liquid-handling conduit that is fluidly connected to an outlet that provides a liquid spray orifice of the spray head assembly; and at least one integrated liquid-handling core nozzle center air conduit configured to receive air exiting at least one center air passage of the saddle and fluidly connected to an integrated liquid-handling core nozzle center air outlet that provides a center air orifice of the spray head assembly.

10. The spray head assembly of claim 1 wherein the liquid-handling core comprises a hollow shaft comprising:

an elongate interior chamber at least a portion of which comprises at least a forwardmost portion of a liquid-handling passage of the liquid-handling core; and, a longitudinal axis that is generally aligned with the direction of liquid flow through the elongate interior chamber of the hollow shaft;

and wherein the liquid handling core is slidably engageable into the saddle along an axis generally aligned with a longitudinal axis of the hollow shaft of the liquid handling core.

11. The spray head assembly of claim 10 wherein the protruding portion protrudes outward at an angle from the hollow shaft of the liquid-handling core; and, comprises a liquid-entry passage that is fluidly connected to the liquid-handling passage inlet of the core and that is fluidly connected, by way of a liquid-handling junction, to the elongate interior chamber of the hollow shaft of the liquid-handling core.

12. The spray head assembly of claim 10 wherein the saddle comprises:

at least one center air passage that extends from a center air passage inlet to a center air passage outlet;

at least one fan air passage that extends from a fan air passage inlet to a fan air passage outlet; and, an elongated cavity that extends through a longitudinal extent of the saddle from a rearmost end of the saddle to a forwardmost end of the saddle and that is configured to slidably receive at least the hollow shaft of the liquid-handling core.

13. The spray head assembly of claim 1 wherein when the liquid-handling core is in its slidably engaged position within the air-handling saddle, the core and saddle collectively provide a center air delivery annulus and a fan air delivery annulus, and wherein when the air cap is attached to the saddle:

the center air delivery annulus provided by the core and saddle combines with at least some surfaces of the air cap to at least partially define a center air chamber that is configured to distribute center air to a center air orifice of the spray head assembly; and, the fan air delivery annulus provided by the core and saddle combines with at least some surfaces of the air cap to provide a fan air chamber that is configured to distribute fan air to at least two air horns that project forward past a liquid handling passage outlet of the liquid-handling core.

14. The spray head assembly of claim 1 wherein the liquid-handling core comprises at least one liquid-handling core registration feature that is configured to slidably engage with, and mate to, at least one air-handling saddle registration feature when the liquid-handling core is slidably engaged into the air-handling saddle.

15. The spray head assembly of claim 14 wherein the liquid-handling core registration feature and the air-handling saddle registration feature are configured to slidably engage with each other along an axis that is generally parallel to a longitudinal axis of a hollow shaft of the liquid handling core, in a manner that does not prevent the liquid-handling core from being slidably disengaged from the air-handling saddle.

16. The spray head assembly of claim 1 wherein the liquid-handling core is slidably engagable into the air-handling saddle along an axis that is generally aligned with a longitudinal axis of a hollow shaft of the liquid-handling core.

17. The spray head assembly of claim 1 wherein when the liquid-handling core is in its engaged position within the air-handling saddle, all surfaces of the liquid-handling core and of the air-handling saddle, in areas of contact between surfaces of the liquid-handling core and the air-handling saddle, are hard surfaces.

18. A spray gun comprising the spray head assembly of claim 1 attached to a liquid spray gun platform.

19. A method of changing a liquid-handling core of a spray head assembly, comprising:

slidably engaging a second liquid-handling core into an air-handling saddle in a direction from a forwardmost end toward a rearwardmost end of the air-handling saddle, the second liquid-handling core comprising a protruding portion that engages with an interrupted annulus of the air-handling saddle, wherein the second liquid-handling core does not comprise any center air or fan air passages leading through any portion of the liquid-handling core.

20. A spray head assembly for use with a liquid spray gun platform, comprising:

an air-handling saddle that is attachable to the liquid spray gun platform, an air cap that is attachable to the air-handling saddle, and a liquid-handling core that is slidably engagable into the air-handling saddle in a direction from a forwardmost end toward a rearwardmost end of the air-handling saddle, wherein the liquid-handling core does not comprise any center air or fan air passages leading through any portion of the liquid-handling core;

wherein the air-handling saddle consists of a unitary piece of integrally molded plastic that comprises an interrupted annulus, at least one center air passage, and at least one fan air passage.

21. A spray head assembly for use with a liquid spray gun platform, comprising:

an air-handling saddle that is attachable to the liquid spray gun platform, the air-handling saddle comprising an interrupted annulus;

an air cap that is attachable to the air-handling saddle, and a liquid-handling core that is slidably engagable into the air-handling saddle, the liquid-handling core comprising a protruding portion that is engagable within the interrupted annulus of the air-handling saddle;

wherein the liquid-handling core consists of a unitary piece of molded plastic that is removable from the saddle and that is disposable; and, wherein the liquid-handling core does not include a needle that is removable from the liquid spray gun platform along with the liquid-handling core;

wherein the liquid-handling core does not include, or provide any part of, a center air passage or a fan air passage; and, wherein a liquid-handling passage of the liquid-handling core comprises a liquid-handling junction that fluidly connects a liquid-entry passage that is within a hollow protrusion that protrudes generally radially outward from a hollow shaft of the liquid-handling core, to an elongate chamber within the hollow shaft of the liquid-handling core, and wherein when the core is slidably engaged into the air-handling saddle and the air-handling saddle is attached to the liquid spray gun platform, no part of the liquid spray gun platform is located forward of the liquid-handling junction of the liquid-handling passage of the liquid-handling core.

22. The spray head assembly of claim 1 wherein the air-handling saddle comprises an annulus that is interrupted to accommodate the protruding portion of the liquid-handling core upon sliding engagement of the liquid-handling core into the air-handling saddle.

23. The spray gun of claim 18 wherein the air-handling saddle comprises an annulus that is interrupted to accommodate the protruding portion of the liquid-handling core upon sliding engagement of the liquid-handling core into the air-handling saddle.

24. The method of claim 19 comprising detaching an air cap from an air-handling saddle of the spray head assembly; and slidably disengaging a first liquid-handling core from the air-handling saddle and removing the core from contact with the saddle.

25. The method of claim 24 comprising attaching the same or another air cap to the air-handling saddle in such manner that the second liquid-handling core is secured in place in the air-handling saddle by the attaching of the air cap to the air-handling saddle.

26. The method of claim 19 wherein the second liquid-handling core comprises a liquid-handling passage inlet to mate with a separate container containing a liquid to be sprayed.

27. The method of claim 26 comprising mating a container containing a liquid to be sprayed with the liquid-handling passage inlet.

28. The spray head assembly of claim 21 wherein the liquid-handling core comprises a liquid-handling passage inlet to mate with a separate container containing a liquid to be sprayed.

* * * * *